US011543099B2

(12) United States Patent
Marquardt et al.

(10) Patent No.: US 11,543,099 B2
(45) Date of Patent: Jan. 3, 2023

(54) LUMINAIRE WITH TRI-RADIAL OPTIC

(71) Applicant: ABL IP Holding LLC, Atlanta, GA (US)

(72) Inventors: Craig Eugene Marquardt, Covington, GA (US); Yinan Wu, Dunwoody, GA (US); Richard H S Bella, Snellville, GA (US); Melissa Ricketts, Conyers, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 17/723,961

(22) Filed: Apr. 19, 2022

(65) Prior Publication Data

US 2022/0333760 A1 Oct. 20, 2022

Related U.S. Application Data

(60) Provisional application No. 63/176,587, filed on Apr. 19, 2021.

(51) Int. Cl.

| | |
|---|---|
| ***F21V 5/04*** | (2006.01) |
| ***F21V 5/00*** | (2018.01) |
| *F21Y 115/10* | (2016.01) |
| *F21Y 105/18* | (2016.01) |

(52) U.S. Cl.

CPC ..... *F21V 5/045* (2013.01); *F21V 5/007* (2013.01); *F21Y 2105/18* (2016.08); *F21Y 2115/10* (2016.08)

(58) Field of Classification Search

CPC ..... F21V 5/045; F21V 5/007; F21Y 2105/18; F21Y 2115/10

See application file for complete search history.

(56) References Cited

U.S. PATENT DOCUMENTS

| | | | | |
|---|---|---|---|---|
| 2012/0081897 | A1* | 4/2012 | Ogawa | G02B 3/08 362/245 |
| 2018/0220508 | A1* | 8/2018 | Pilat | F21S 8/061 |
| 2021/0247035 | A1* | 8/2021 | Lim | F21V 5/002 |

* cited by examiner

*Primary Examiner* — Evan P Dzierzynski

(74) *Attorney, Agent, or Firm* — Kilpatrick Townsend & Stockton LLP

(57) ABSTRACT

A luminaire may include a light engine comprising a plurality of LEDs arranged in one or more annular rows. The luminaire may include an optic. The optic may include an annular optic body having a light entrance side facing the plurality of LEDs and a light exit side opposite the light entrance side. A plurality of annular grooves may be defined within the light exit side, the plurality of annular grooves being coaxial with the optic body. A plurality of arc-shaped grooves may be defined within the light exit side. Each of the plurality of arc-shaped grooves may be convex relative to a center of the optic. Each of the plurality of arc-shaped grooves may intersect at least one of the plurality of annular grooves. The optic may be configured to produce a Unified Glare Rating of less than 28.

20 Claims, 15 Drawing Sheets

LUMINAIRE WITH TRI-RADIAL OPTIC

CROSS-REFERENCES TO RELATED APPLICATIONS

This application claims the benefit of and is a non-provisional of U.S. Provisional Application Ser. No. 63/176,587 filed on Apr. 19, 2021, which is hereby expressly incorporated by reference in its entirety for all purposes.

BACKGROUND

Luminaires typically include one or more light emitters accompanied by optional optical enhancements (reflectors, lenses, diffusers, etc.) to control the directionality and/or appearance of the light as it exits the luminaire. These light emitters and optional optics are typically housed in a luminaire housing that can take on a variety of different shapes, sizes, and other geometries. Luminaires sometimes provide a bright area on the fixture from which light emanates, that can be in stark contrast to the lighting environment surrounding the luminaire. This contrast increases the glare perception of an observer and can make the light visibly uncomfortable to the observer. Improvements to reduce glare in luminaire are desired, while still providing sufficient luminous area to minimize the number of luminaires needed to light a given area.

BRIEF SUMMARY

Some embodiments of the present technology may encompass luminaires that may include a light engine comprising a plurality of LEDs arranged in one or more annular rows. The luminaires may include an optic. The optic may include an annular optic body having a light entrance side facing the plurality of LEDs and a light exit side opposite the light entrance side. The optic may include a plurality of annular grooves defined within the light exit side. The plurality of annular grooves may be coaxial with the optic body. The optic may include a plurality of arc-shaped grooves defined within the light exit side. Each of the plurality of arc-shaped grooves may be convex relative to a center of the optic. Each of the plurality of arc-shaped grooves may intersect at least one of the plurality of annular grooves. The optic may be configured to produce a Unified Glare Rating of less than 28.

In some embodiments, the plurality of arc-shaped grooves may include a first plurality of arc-shaped grooves and a second plurality of arc-shaped grooves. The first plurality of arc-shaped grooves may be coaxial with one of a plurality of first central axes that are radially outward of an outer edge of the optic body. The second plurality of arc-shaped grooves may be coaxial with one of a plurality of second central axes that are each substantially aligned with the outer edge of the optic body. Each of the plurality of first central axes and each of the plurality of second central axes may be angularly offset from one another. Each of the first plurality of arc-shaped grooves may intersect at least one of the second plurality of arc-shaped grooves. Individual ones of the first plurality of arc-shaped grooves may have greater radii of arc-shaped grooves than individual ones of the second plurality of arc-shaped grooves that are at similar radial positions of the optic. The plurality of first central axes may include three first central axes spaced apart about a circumference of the optic body. The plurality of second central axes may include three second central axes spaced apart about the circumference of the optic body. Each of the plurality of annular grooves and each of the plurality of arc-shaped grooves may include a v-groove. An angle of each of the plurality of annular grooves and an angle of each of the plurality of arc-shaped grooves may be substantially the same relative to a reference plane that is orthogonal to a depth of each of the plurality of annular grooves. The angle of each of the plurality of annular grooves and the angle of each of the plurality of arc-shaped grooves may be between about 20 degrees and 45 degrees relative to the reference plane. At least about 95% of the light exit side may be non-planar.

Some embodiments of the present technology may encompass optics that may include an annular optic body having a light entrance side and a light exit side. The optics may include a plurality of annular grooves defined within the light exit side. The plurality of annular grooves may be coaxial with the optic body. The optic may include a plurality of arc-shaped grooves defined within the light exit side. Each of the plurality of arc-shaped grooves may be convex relative to a center of the optic. Each of the plurality of arc-shaped grooves may intersect at least one of the plurality of annular grooves. The optic may be configured to produce a Unified Glare Rating of less than 28.

In some embodiments, the plurality of arc-shaped grooves may include a first plurality of arc-shaped grooves and a second plurality of arc-shaped grooves. The first plurality of arc-shaped grooves may be coaxial with one of a plurality of first central axes that are radially outward of an outer edge of the optic body. The second plurality of arc-shaped grooves may be coaxial with one of a plurality of second central axes that are each substantially aligned with the outer edge of the optic body. The plurality of first central axes may be disposed at 120° intervals about the optic body. The plurality of second central axes may be disposed at 120° intervals about the optic body. The plurality of first central axes may be offset from the plurality of second axes by 60°. Outermost arc-shaped grooves of the first plurality of arc-shaped grooves may have greater depths than more inward arc-shaped grooves of the first plurality of arc-shaped grooves. Outermost arc-shaped grooves of the second plurality of arc-shaped grooves may have greater depths than more inward arc-shaped grooves of the second plurality of arc-shaped grooves. The optic body may include a plurality of arcuate segments. Each of the plurality of segments may define a subset of the plurality of annular grooves, the first plurality of arc-shaped grooves, and the second plurality of arc-shaped grooves. Each of the plurality of second central axes may be azimuthally aligned with an intersection between two of the plurality of segments. One or more of the first plurality of arc-shaped grooves may intersect one or more of the second plurality of arc-shaped grooves.

Some embodiments of the present technology may encompass optics that may include an arcuate optic body having a light entrance side and a light exit side. The optics may include a plurality of annular grooves defined within the light exit side. The plurality of annular grooves may be coaxial with the optic body. The optics may include a first plurality of arc-shaped grooves defined within the light exit side. Each of the first plurality of arc-shaped grooves may be coaxial with a first central axis that is radially outward of an outer edge of the optic body. The optics may include a second plurality of arc-shaped grooves defined within the light exit side. Each of the second plurality of arc-shaped grooves may be coaxial with one of a plurality of second central axes that are each substantially aligned with the outer edge of the optic body. Each of the plurality of first arc-shaped grooves and each of the plurality of second arc-shaped grooves may intersect at least one of the plurality of annular grooves. The optic may be configured to produce a Unified Glare Rating of less than 28.

In some embodiments, a depth of at least one of the first plurality of arc-shaped grooves may be different from a depth of at least one other of the first plurality of arc-shaped grooves. A depth of at least one of the second plurality of arc-shaped grooves may be different from a depth of at least one other of the second plurality of arc-shaped grooves. The light entrance side of the optic body may be substantially planar. Each of the second central axes may be substantially aligned with an outer corner of the optic body.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The subject matter of embodiments of the present disclosure is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present disclosure are directed to secondary stage optics and luminaires that add light emitting diode (LED) pixilation (filling in gaps between individual LEDs to create a uniform and cohesive visual effect that fully saturates the eye) and visual break-up that do not affect a primary stage optic's ability to provided intended optical angles and distributions. Embodiments of the present disclosure may add pixilation by up to 3 to 4 times the visual presence of the number of LEDs, which may result in an optic/luminaire that produces light which fully saturates the eye and makes the lens look more uniformly illuminated. Embodiments may enable a luminaire that includes the optics to emit low angle light that produces a light distributions that may have a low amount of glare. In particular, the optics described herein may produce light distributions that meet various glare standards, such as that produce a Unified Glare Rating (UGR) of less than 28 which may enable the optic (and subsequent luminaire) to meet various industry glare standards. In some embodiments, the UGR value may be based on the crosswise and endwise values for a 4H by 8H mounting ratio for a 70/50/20% reflectance, however the present invention is not so limited. For example, as referred to herein the UGR values may encompass UGR values in other mounting ratios/reflectance values/directions. In particular, the UGR values may encompass UGR values for a mounting ratio of 2H by 2H through 2H by 12H for all ceiling/wall/plane reflectance values in either a crosswise or endwise direction, a mounting ratio of 4H by 4H through 2H by 3H for all ceiling/wall/plane reflectance values in either a crosswise or endwise direction, and/or a mounting ratio of 4H by 2H through 4H by 8H for 70% ceiling reflectance/50% wall reflectance/20% plane reflectance in either a crosswise or endwise direction.

Figure 1:
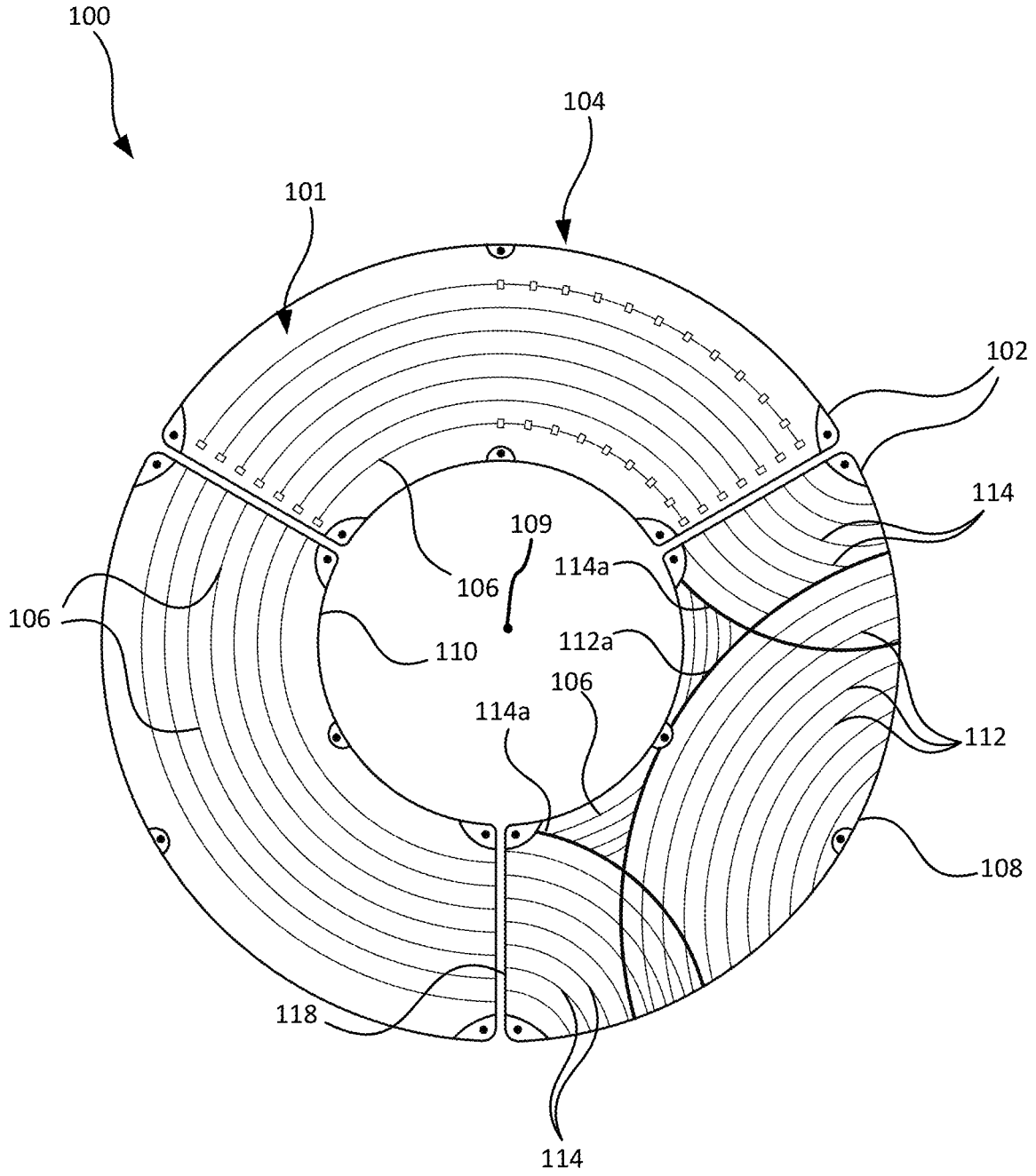
FIG. 1 illustrates a schematic top plan view of an optic according to embodiments.

Turning now to FIG. 1, one embodiment of an optic 100 is illustrated. In some embodiments, the optic 100 may be formed as a microfilm, while in other embodiments the optic 100 may be formed as a mechanical optic that is injection-molded, machined, and/or otherwise formed. The optic 100 may be a secondary optic in some embodiments, and may be placed against a primary optic and/or light engine to create a luminaire. In some embodiments, the optic 100 may be formed from a single (unitary) piece of material, while in other embodiments the optic 100 may be formed from a number of arc-shaped segments 102, which may be arranged relative to one another to create a generally annular shape. The optic 100 may be made of a transparent material, such as glass, silicone, acrylic, polycarbonate, and the like. While shown here with three segments 102, more or fewer segments 102 may be used to produce an optic 100 having similar physical characteristics as described below. The optic 100 may include an optic body 101 that includes a light entrance side 103 (shown in FIGS. 1E and 1F) that is configured to face one or more light sources of a luminaire (e.g., a plurality of LEDs or other light emitting elements) and a light exit side 104 (shown in FIGS. 1 and 1A) opposite the light entrance side 103. The optic body 101 may include an inner surface 108 and an outer surface 110 that defines an inner edge and an outer edge of the optic body 101 and that extend between the light entrance side 103 and the light exit side 104. In embodiments where the optic is formed from multiple segments 102, each segment 102 may include ends 118 that extend between and couple the light entrance side 103, the light exit side 104, the inner surface 108, and the outer surface 110. A number of grooves and/or ridges that may extend into or protrude out from a primary surface 105 of the light exit side 104. These grooves and/or ridges combine to trim off high angle light (such as light at greater than about 60 degrees from vertical) to help reduce glare, while also pixilating the light from LEDs to more uniformly light the luminous area.

The light entrance side 103 may be substantially planar in some embodiments, and may include zero or few (e.g., fewer than 10, fewer than 5, fewer than 3, etc.) features that protrude into or out of a primary surface 107 of the light entrance side 103. For example, at least or about 95% of the light entrance side 103, at least or about 97% of the light entrance side 103, at least or about 98% of the light entrance side 103, at least or about 99% of light entrance side 103, or more may be planar (e.g., devoid of grooves, ridges, and/or other optical features). The light exit side 104 may be substantially nonplanar in some embodiments, as planar features may disrupt the light distribution produced by the grooves formed in the optic 100. For example, at least or about 95% of the light exit side 104, at least or about 97% of the light exit side 104, at least or about 98% of the light exit side 104, at least or about 99% of light exit side 104, or more may be nonplanar (i.e., made up of a number of annular grooves 106 and/or ridges that are adjacent one another with no planar portions disposed therebetween).

Light rays emitted from one or more light sources may be incident on the substantially planar surface of the light entrance side 103 and may be refracted into the optic body 101. The optic body 101 may be selected to have a refractive index of between 1.3 to 1.7 for visible light, which may cause a light ray incident at a 90-degree angle of incidence (e.g., at grazing incidence, which is the largest possible angle of incidence), the angle of refraction (i.e., the angle between the refracted light rays and the normal of the light entrance side 103) would be about 45 degrees. Therefore, the angles of refraction for the refracted light rays may be equal to or less than about 45 degrees.

The refracted light rays may be incident on the light exit side 104, and may be refracted out of the optic body 101 through the annular grooves 106. With proper selection of the groove angles at light exit side 104, it is possible to limit the exit angles of the refracted light rays with respect to vertical to about 60 degrees or less. The term "vertical" refers herein to the direction normal to the light entrance side 103, which may be aligned with the optical axes of the light emitting elements in some embodiments. Limiting the exit angles of the refracted light rays with respect to vertical to about 60 degrees or less may be achieved by having the flat surface as light entrance side 103 and the grooved surface as the light exit side 104. According to various embodiments, the refractive index of the optic body 101 may be in a range from about 1.3 to about 1.7, or from about 1.4 to about 1.6. Thus, the combination of the substantially planar light entrance side 103 and the substantially nonplanar light exit side 104 may produce a light distribution that cuts off light above about 60 degrees from vertical and may produce a Unified Glare Rating of less than 28.

Figure 1A:
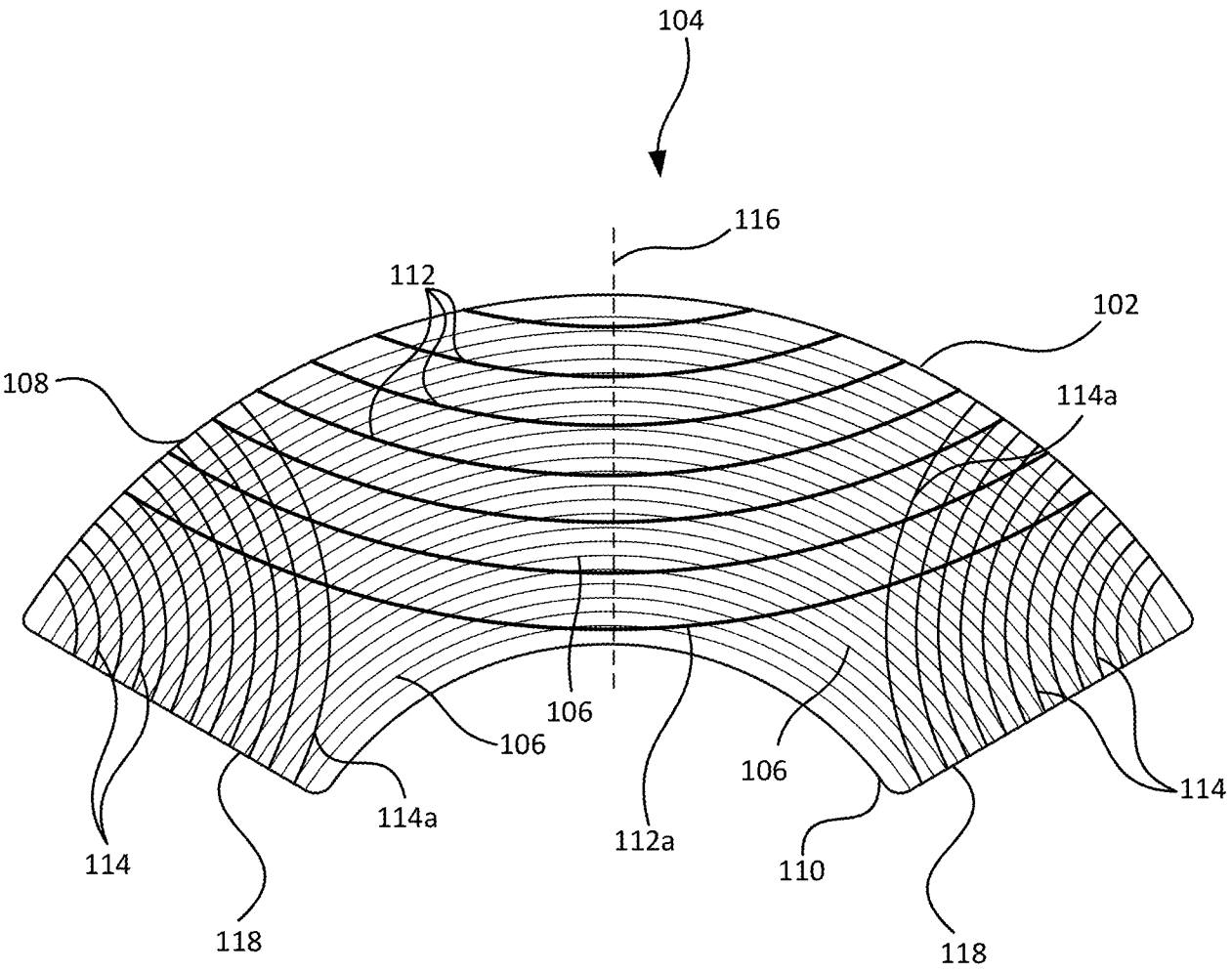
FIG. 1A illustrates a schematic top plan view of one segment of the optic of FIG. 1.
Figure 1B:
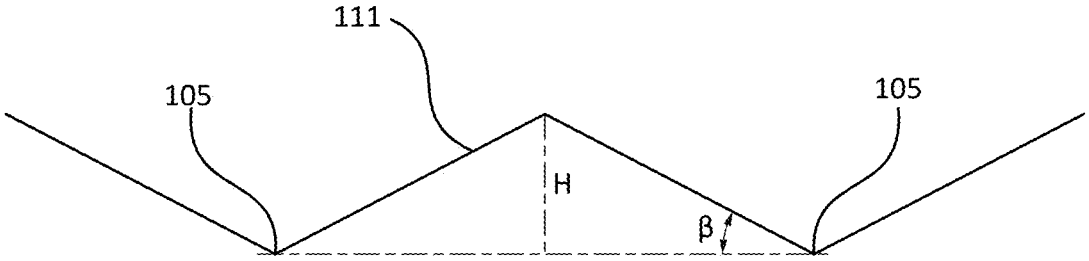
FIG. 1B illustrates a cross-sectional view of a ridge of the optic of FIG. 1.

FIG. 1B illustrates one embodiment of segment 102, which may be representative of each of the segments 102 of the optic 100. As illustrated, the light exit side 104 of each arc-shaped segment 102 may define a number of annular grooves 106. Each annular groove 106 may have an arc-shaped path and may be parallel with an edge of the outer surface 110 and inner edge 108 of each segment 102 along a length of each segment 102. For example, each annular groove 106 may be coaxial with the arc-shaped segment 102 such that a center point 109 of each annular groove 106 may be a center point of the optic 100. When the segments 102 are assembled into an annular shape to form optic 100, the annular groove 106 of each segment 102 may together form annular shapes. Thus, while on an individual segment 102 the annular grooves 106 are provided as arcs, such grooves may be referred to as annular grooves 106. Any number of annular grooves 106 may be provided on the surface of each segment 102. In some embodiments, the annular grooves 106 may be arranged at equal, substantially equal, and/or unequal intervals across a width of the segment 102. In some embodiments, an innermost annular groove 106 may be spaced from the inner edge 108 by a same distance as the interval between each adjacent annular groove 106, while in other embodiments, the innermost annular groove 106 may be spaced from the inner edge 108 by a lesser or greater distance. Similarly, the outermost annular groove 106 may be spaced from the edge of the outer surface 110 by a same distance as the interval between each adjacent annular groove 106, while in other embodiments, the outermost annular groove 106 may be spaced from an edge of the outer surface 110 by a lesser or greater distance. A number of annular grooves 106 across a surface of the optic 100 may be based on the angle of each annular groove 106 (i.e., 20-45 degrees relative to horizontal (or a reference plane that is parallel to the light entrance side 103 and/or orthogonal to a depth of each groove) shown by angle $\beta$ in FIG. 1B) and a width of the base of the triangle cross section for each annular groove 106. In a particular embodiment, the width of the base of each annular groove 106 may be 2.64 mm, however, any number of width values are possible in various embodiments. Oftentimes, a width of the base of each annular groove 106 may be between about 1 mm and 4 mm. Some or all of the annular grooves 106 may be disposed so as to be aligned with LEDs on a light engine in some embodiments. For example, the light engine may include a number of LEDs arranged in one or more annular rows that extend radially outward from a center point. Each of the LEDs may be aligned with a center (or valley) of a respective one of the annular grooves 106. This may enable the Fresnel lines of the ridges to align with the LEDs, thereby enabling the annular grooves 106 to control distribution of light from the LEDs to narrowly focus the light. In other embodiments, some or all of the annular grooves 106 may be offset radially from one or more of the LEDs.

Figure 1C:
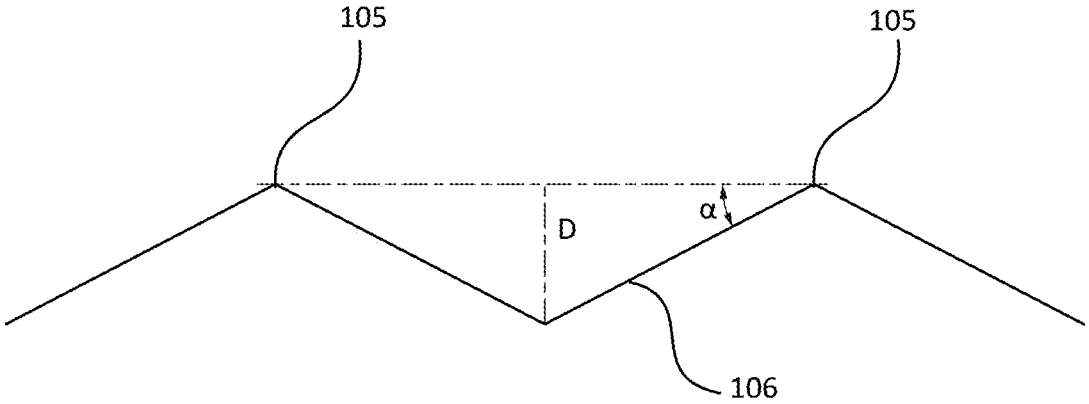
FIG. 1C illustrates a cross-sectional view of a v-shaped groove of the optic of FIG. 1.

In some embodiments, the annular grooves 106 may each have a v-shaped cross-sectional shape as shown in FIG. 1C. An angle $\alpha$ of each side of the annular groove 106 relative to the primary surface of the light exit side 104 of the optic 100 may be between about 20 degrees and 45 degrees, between about 25 degrees and 40 degrees, or between about 30 degrees and 35 degrees. A depth D of each annular groove 106 may be between about 0.010 and 0.050 inches, between about 0.015 and 0.045 inches, between about 0.020 and 0.040 inches, between about 0.025 and 0.035 inches, or about 0.030 inches relative to the primary surface of the light exit side 104.

In some embodiments, rather than being grooves, each annular groove 106 may be in the form of a ridge that protrudes outward from the light exit side 104. FIG. 1B illustrates a cross-sectional shape of a ridge 111 that may be used in place of annular grooves 106 (or other grooves of the optic 100) in some embodiments. Each ridge 111 may have a prismatic cross-sectional shape as shown in FIG. 1B. For example, the ridges 111 may each be formed to have a triangular prism cross-section. An angle θ of each protruding side of the ridge 111 relative to the primary surface of the light exit side 104 of the optic 100 may be between about 20 degrees and 45 degrees, between about 25 degrees and 40 degrees, or between about 30 degrees and 35 degrees. A height H of each ridge 111 may be between about 0.010 and 0.050 inches, between about 0.015 and 0.045 inches, between about 0.020 and 0.040 inches, between about 0.025 and 0.035 inches, or about 0.030 inches relative to the primary surface of the light exit side 104.

Figure 1D:
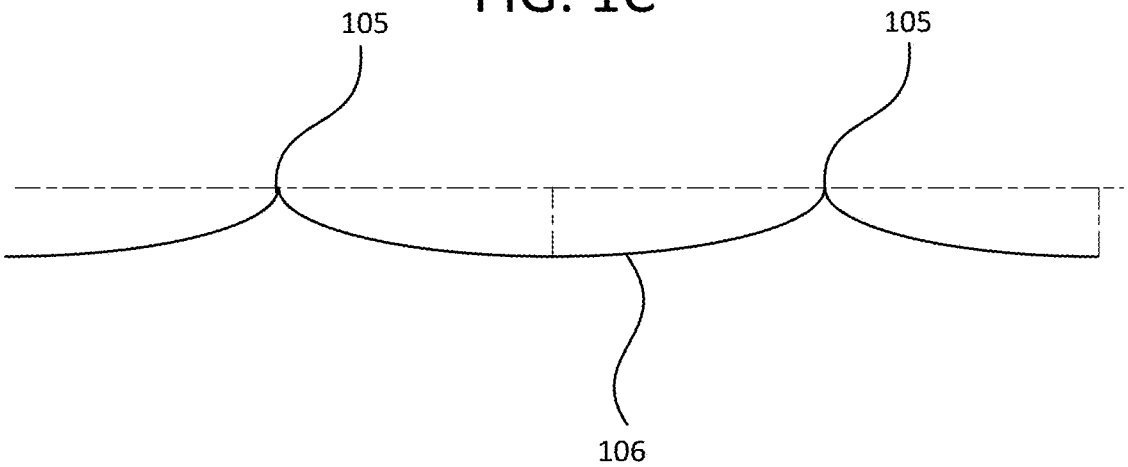
FIG. 1D illustrates a cross-sectional view of an ellipse-shaped groove of the optic of FIG. 1.

In other embodiments, the annular grooves 106 may each have a contoured cross-sectional shape as shown in FIG. 1D. For example, the annular groove 106 may each be formed to have a half-ellipse shaped cross-section. A depth d of each half-ellipse annular groove 106 may be between about 0.005 and 0.035 inches, between about 0.010 and 0.030 inches, between about 0.015 and 0.025 inches, or about 0.020 inches relative to the primary surface of the light exit side 104. In a particular embodiment, a width of each half-ellipse annular groove 106 may be between about 1.5 mm and 4 mm. In another example, the annular grooves 106 may each be formed to have radial-shaped cross-sections, such as semi-circles. A radius of each radial groove 112 may be between about 0.005 and 0.035 inches, between about 0.010 and 0.030 inches, between about 0.015 and 0.025 inches, or about 0.020 inches relative to the primary surface of the light exit side 104.

Figure 6:
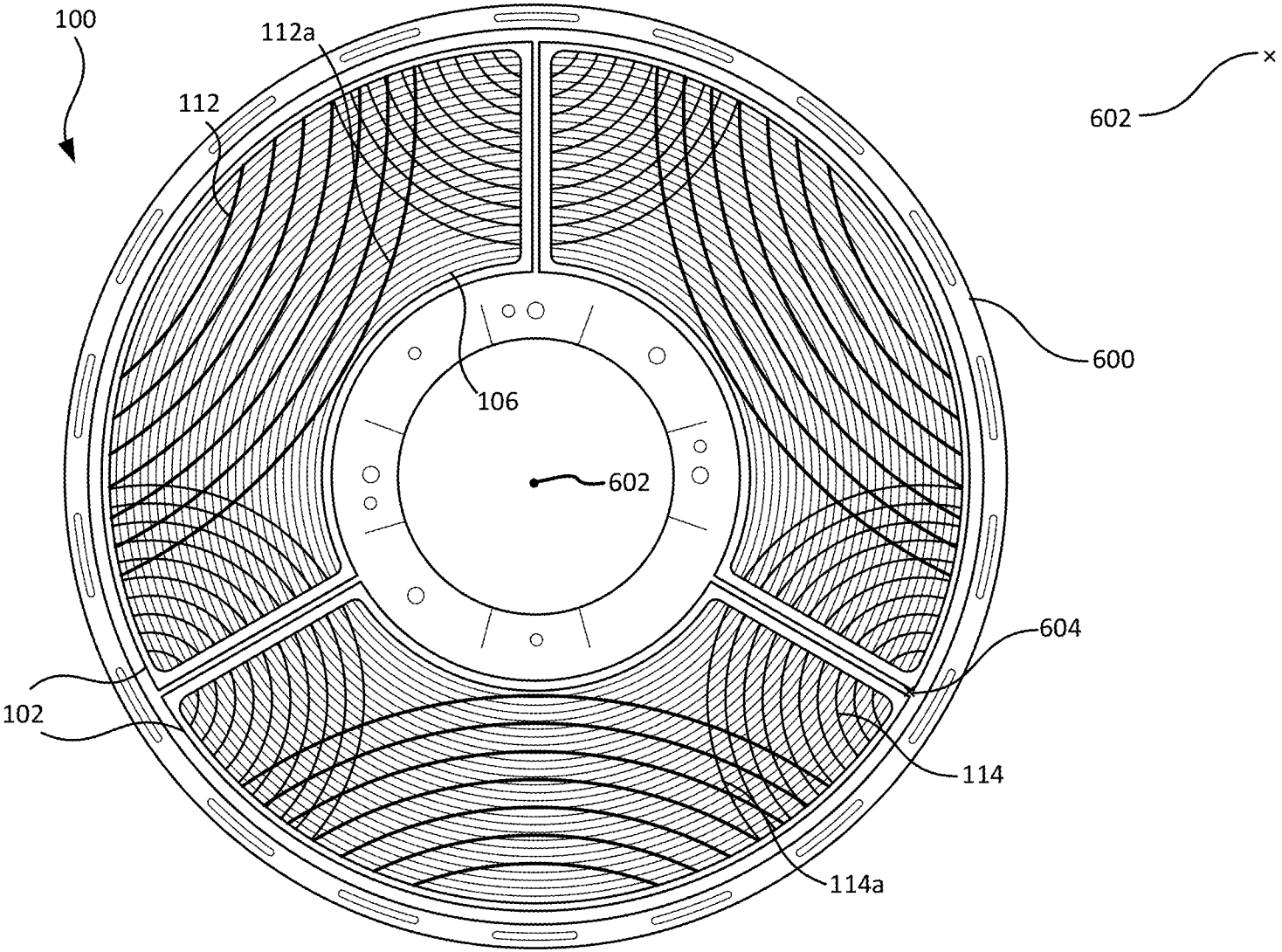
FIG. 6 illustrates a schematic top plan view of an optic according to embodiments.

Turning back to FIG. 1A, the light exit side 104 of each segment 102 may define a first set of arc-shaped grooves 112. The arc-shaped grooves 112 may be coaxial with one another, with a central axis (602 as shown in FIG. 6) of the arc-shaped grooves 112 being outward of the edge of the outer surface 110 of the segment 102 and in alignment with a center line 116 of the segment 102 and/or a center line splitting both lenses. Each of the arc-shaped grooves 112 may be convex relative to a center of the optic 100 such that an orientation of the arc-shaped grooves 112 is opposite that of the annular grooves 106. The radius of each arc-shaped groove 112 may have varying dimensions and, in some embodiments may include arcs, curves, compounding curves and/or straight lines. In other words, arc-shaped grooves 112 may have arcs that have an opposite orientation as the annular grooves 106 described above. Thus, when assembled, the segments 102 provide three sets of arc-shaped grooves 112, with a set of arc-shaped grooves 112 centered about three separate axes spaced at 120 degree intervals about the optic 100.

Any number of arc-shaped grooves 112 may be provided on the surface of each segment 102. In some embodiments, the arc-shaped grooves 112 may be arranged at equal intervals across a width of the segment 102. In a particular embodiment, the arc-shaped grooves 112 may be spaced apart by between about 9 and 10 mm, however different sized optics 100 and/or arc-shaped grooves 112 may include different valley-to-valley spacing. At least some of the arc-shaped grooves 112 may intersect at least one of the annular grooves 106. In some embodiments, each arc-shaped groove 112 intersects at least one annular groove 106, with some or all of the arc-shaped grooves 112 intersecting multiple annular grooves 106. Intersection between each arc-shaped groove 112 and a respective annular groove 106 may occur at one or two points.

Figure 1E:
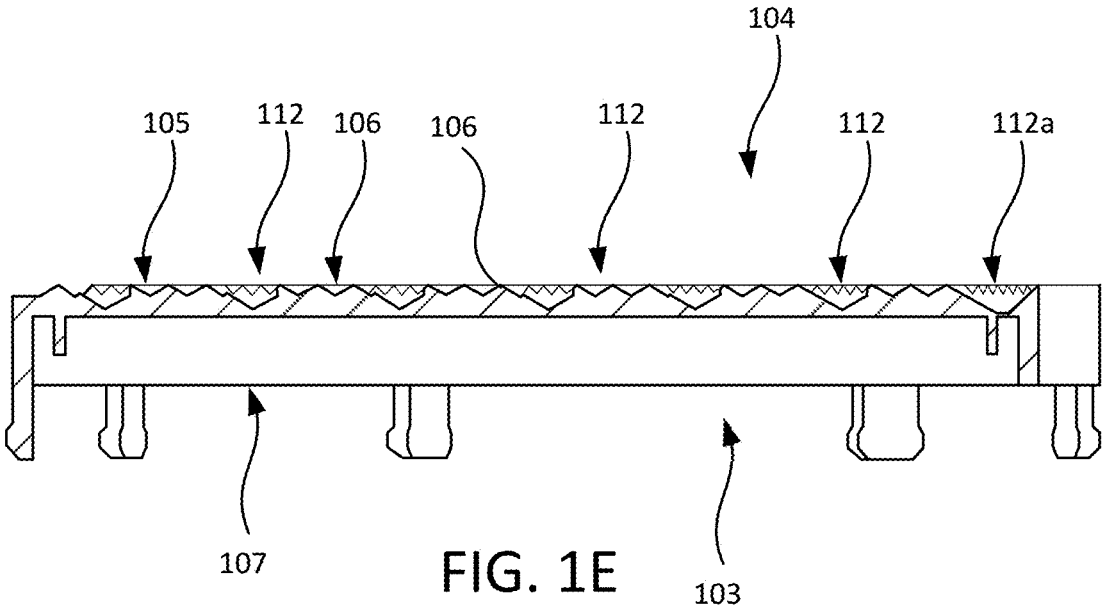
FIG. 1E illustrates a cross section of the segment of FIG. 1A having v-shaped grooves.
Figure 1F:
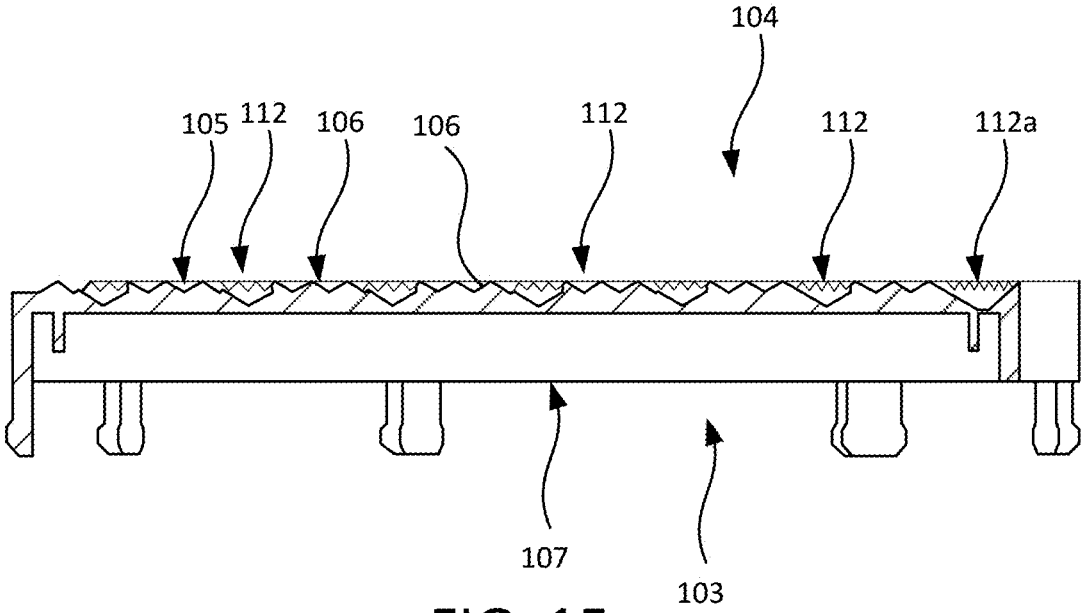
FIG. 1F illustrates a cross section of the segment of FIG. 1A having ellipse-shaped grooves.

In some embodiments, an outermost arc-shaped groove 112*a* relative to central axis 602 of the arc-shaped grooves 112 (e.g., the arc-shaped groove 112 that extends furthest inward into the optic 100), may be sized and/or shaped differently than the other arc-shaped grooves 112 as best illustrated in the cross-sectional view of FIG. 1E (v-shaped arc-shaped grooves 112) and FIG. 1F (ellipse-shaped arc-shaped grooves 112) taken along the center radial line 116 of the segment 102 shown in FIG. 1A. The larger outermost arc-shaped groove 112*a* may create a visual hierarchy of size that provides an aspect ratio that helps make each group of ridges and/or grooves visible in one or more groups and prevents the ridges and/or grooves from being visually lost in a mixture. For example, the outermost arc-shaped groove 112*a* may have a v-shaped cross-sectional shape, with an angle α of each side of the arc-shaped groove 112*a* relative to the primary surface of the light exit side 104 of the optic 100 being between about 20 degrees and 45 degrees, between about 25 degrees and 40 degrees, or between about 30 degrees and 35 degrees. A depth D of arc-shaped groove 112*a* may be between about 0.030 and 0.090 inches, between about 0.035 and 0.085 inches, between about 0.040 and 0.080 inches, between about 0.045 and 0.075 inches, between about 0.050 and 0.070 inches, between about 0.055 and 0.065 inches, or about 0.060 inches relative to the primary surface of the light exit side 104. In other embodiments, the outermost arc-shaped groove 112*a* may have a half-ellipses shaped cross-section, with a depth D of arc-shaped groove 112*a* being between about 0.010 and 0.050 inches, between about 0.015 and 0.045 inches, between about 0.020 and 0.040 inches, between about 0.025 and 0.035 inches, or about 0.030 inches relative to the primary surface of the light exit side 104. In other embodiments, the arc-shaped groove 112*a* may have a radial-shaped cross-section, with a radius of each radial arc-shaped groove 112 being between about 0.010 and 0.050 inches, between about 0.015 and 0.045 inches, between about 0.020 and 0.040 inches, between about 0.025 and 0.035 inches, or about 0.030 inches relative to the primary surface of the light exit side 104.

In some embodiments, the arc-shaped grooves 112 may be arranged such that outermost arc-shaped groove 112 is proximate an edge of the inner surface 108, while a radius of the outermost arc-shaped groove 112 is selected such that distal ends of the outermost arc-shaped groove 112 extend through the edge of the outer surface 110 without passing beyond the corner of the segment 102. In other words, the distal ends of the outermost arc-shaped groove 112 may terminate without extending through the ends 118 of the optic 100.

The light exit side 104 of each segment 102 may define a second set of arc-shaped grooves 114. For example, each end 118 of the segment 102 may define a section of arc-shaped grooves 114. Each section of arc-shaped grooves 114 may be coaxial with one another, with a center point of each section of arc-shaped grooves 114 aligned or proximate with an edge of the outer surface 110 of the segment 102 and substantially aligned with a respective end 118 of the segment. For example, the central point of each section of arc-shaped grooves 114 may be disposed at or substantially proximate (e.g., within 10 mm, within 8 mm, within 6 mm, within 4 mm, within 2 mm, or less) an outer corner of the segment 102. When assembled, adjacent ends of the segments 102 may define a substantially semicircular set of arc-shaped grooves 114 such that a set of arc-shaped grooves 114 is centered about three separate axes spaced at 120 degree intervals about the optic 100. Central axes (604 as shown in FIG. 6) of arc-shaped grooves 114 may be offset from the central axes 602 of arc-shaped grooves 112 by approximately 60 degrees, such that central axes for arc-shaped grooves 112 and arc-shaped grooves 114 alternate about the circumference of the optic 100, with a central axis positioned at each 60 degree interval. As the center of each arc-shaped groove 114 is closer to the center of the optic 100 than the center of each arc-shaped groove 112, the arc-shaped grooves 114 may have smaller radii than arc-shaped grooves 112.

Any number of arc-shaped grooves 114 may be provided on the surface of each segment 102. Each of the arc-shaped grooves 114 may be convex relative to a center of the optic 100 such that an orientation of the arc-shaped grooves 114 is opposite that of the annular grooves 106. In some embodiments, the arc-shaped grooves 114 may be arranged at equal intervals across a width of the segment 102. In a particular embodiment, the arc-shaped grooves 114 may be spaced apart by between about 6 and 8 mm, however different sized optics 100 and/or arc-shaped grooves 114 may include different valley-to-valley spacing. At least some of the arc-shaped grooves 114 may overlap with and/or otherwise intersect at least one of the annular grooves 106 and/or at least one of the arc-shaped grooves 112. In some embodiments, each arc-shaped groove 114 intersects at least one annular groove 106, with some or all of the arc-shaped grooves 114 intersecting multiple annular grooves 106 and/or arc-shaped grooves 112. Intersection between each arc-shaped groove 112 and a respective annular groove 106 may occur at one or two points. As the central axes of arc-shaped grooves 112 are radially outward from the outer surface 110, radii of the arc-shaped grooves 112 may be greater than radii of arc-shaped grooves 114 whose peaks (e.g., points closest to a center of the optic 100) are at similar radial positions (e.g., similar distances from the central axis) of the optic 100.

In some embodiments, the arc-shaped grooves 114 may each have a v-shaped cross-sectional shape. An angle of each side of the arc-shaped groove 114 relative to the primary surface of the light exit side 104 of the optic 100 may be between about 20 degrees and 45 degrees, between about 25 degrees and 40 degrees, or between about 30 degrees and 35 degrees. A depth of each arc-shaped groove 114 may be between about 0.005 and 0.035 inches, between about 0.010 and 0.030 inches, between about 0.015 and 0.025 inches, or about 0.020 inches relative to the primary surface of the light exit side 104.

In other embodiments, the arc-shaped grooves 114 may each have a contoured cross-sectional shape. For example, the arc-shaped grooves 114 may each be formed to have a half-ellipse shaped cross-section. A depth d of each half-ellipse arc-shaped groove 114 may be between about 0.005 and 0.030 inches, between about 0.006 and 0.025 inches, between about 0.008 and 0.020 inches, between about 0.009 and 0.015 inches, or about 0.010 inches relative to the primary surface of the light exit side 104. In a particular embodiment, a width of each half-ellipse arc-shaped groove 114 may be between about 1.5 mm and 4 mm. In another example, the arc-shaped grooves 114 may each be formed to have radial-shaped cross-sections, such as semi-circles. A radius of each radial arc-shaped groove 114 may be between about 0.005 and 0.030 inches, between about 0.006 and 0.025 inches, between about 0.008 and 0.020 inches, between about 0.009 and 0.015 inches, or about 0.010 inches relative to the primary surface of the light exit side 104.

In some embodiments, an outermost arc-shaped groove 114*a* relative to a central axis of the arc-shaped grooves 114 (e.g., the arc-shaped groove 114 that extends furthest inward into the optic 100), may be sized and/or shaped differently than the other arc-shaped grooves 114. For example, the outermost arc-shaped groove 114*a* may have a v-shaped cross-sectional shape, with an angle of each side of the arc-shaped groove 114*a* relative to the primary surface of the light exit side 104 of the optic 100 being between about 20 degrees and 45 degrees, between about 25 degrees and 40 degrees, or between about 30 degrees and 35 degrees. A depth of arc-shaped groove 114*a* may be between about 0.020 and 0.080 inches, between about 0.025 and 0.075 inches, between about 0.030 and 0.070 inches, between about 0.035 and 0.065 inches, between about 0.040 and 0.060 inches, between about 0.045 and 0.055 inches, or about 0.050 inches relative to the primary surface of the light exit side 104. In other embodiments, the outermost arc-shaped groove 114*a* may have a half-ellipses shaped cross-section, with a depth of arc-shaped groove 114*a* being between about 0.005 and 0.045 inches, between about 0.010 and 0.040 inches, between about 0.015 and 0.035 inches, between about 0.020 and 0.030 inches, or about 0.025 inches relative to the primary surface of the light exit side 104. In other embodiments, the arc-shaped groove 114*a* may have a radial-shaped cross-section, with a radius of each radial arc-shaped groove 114 being between about 0.005 and 0.045 inches, between about 0.010 and 0.040 inches, between about 0.015 and 0.035 inches, between about 0.020 and 0.030 inches, or about 0.025 inches relative to the primary surface of the light exit side 104.

As discussed above, the various ridges and grooves create an optic surface that creates a wider luminous area with fewer LEDs, and increases the uniformity of light and brightness across the luminous area. For example, the annular grooves 106 may focus or otherwise narrow the distribution of light from the LEDs, while the arc-shaped grooves 112, 114 may pixilate the light from LEDs to spread light into the gaps between the LEDs to create more diffuse light that results in a luminaire with a balance of low glare and wide luminous area.

The annular grooves 106, arc-shaped grooves 112, and/or arc-shaped grooves 114 on the optic 100 may each have a same cross-sectional shape, or one or more of the different grooves may have different cross-sectional shape. Additionally, while referred to as grooves, it will be appreciated that any of the annular grooves 106, arc-shaped grooves 112, and/or arc-shaped grooves 114 may be formed as protruding ridges in some embodiments.

While a depth and/or width of each annular groove 106, arc-shaped groove 112, and/or arc-shaped groove 114 on the optic 100 may be the same or different, the angle of each and all such grooves may be substantially equal. For example, the angle (with respect to a reference plane that is parallel to the light entrance side 103 and/or orthogonal to a depth of each groove) of each annular groove 106, arc-shaped groove 112, and/or arc-shaped groove 114 may be within about 5 degrees, within about 4 degrees, within about 3 degrees, within about 2 degrees, within about 1 degree, within about 0.5 degree, or less of each other annular groove 106, arc-shaped groove 112, and/or arc-shaped groove 114. By keeping each of the angles of the grooves at substantially the same angle, interference between intersecting grooves may be reduced and/or eliminated.

As noted above, the optic body 101 may be formed from a single piece of material, or from a number of arc-shaped segments 102, which may be arranged to create a generally annular shape. In embodiments in which a number of arc-shaped segments 102 are utilized, each of the segments 102 may define a subset of the plurality of annular grooves 106, the arc-shaped grooves 112, and the plurality of arc-shaped grooves 114. In some embodiments, some or all of the annular grooves 106 and/or arc-shaped grooves 114 may extend over two or more segments 102 such that each segment 102 includes only a portion of the given groove. In some embodiments, each of the central axes of the arc-shaped grooves 114 may be azimuthally aligned with an intersection between two of the segments 102 such that the respective grooves 114 radiate in a symmetric manner about the intersection of the adjacent segments 102.

Figure 5A:
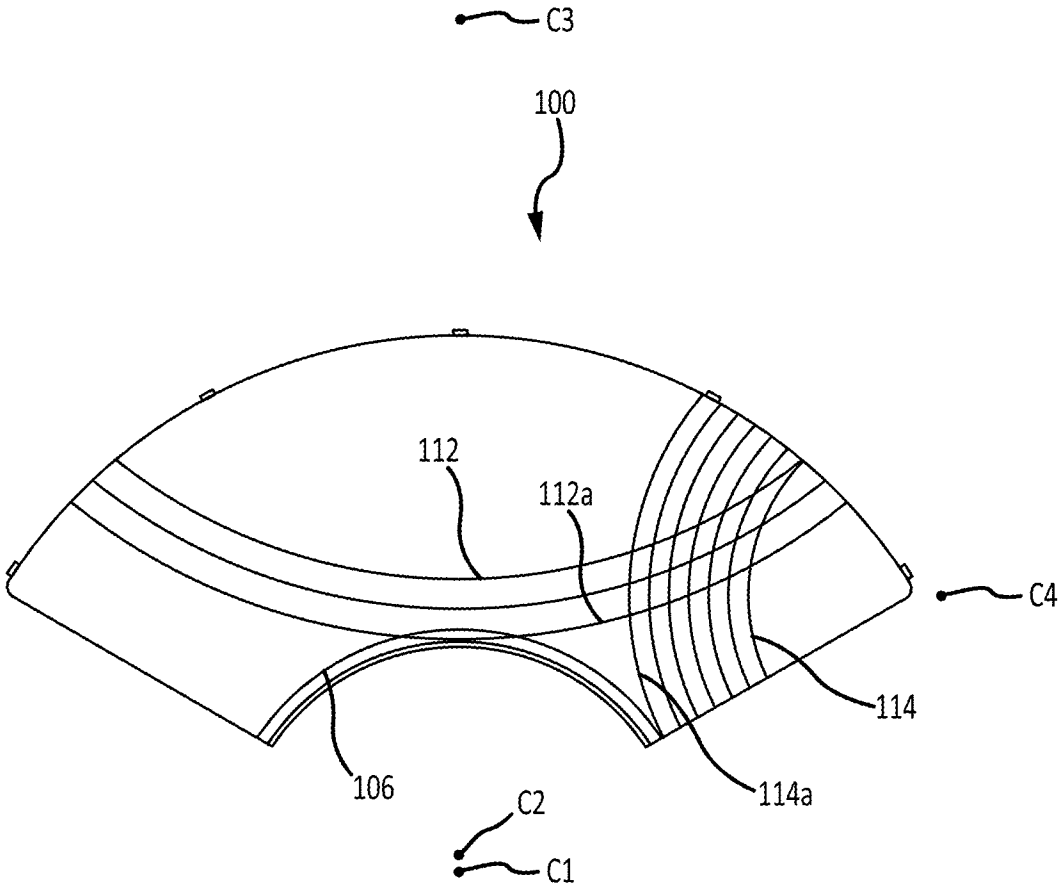
FIG. 5A illustrates a schematic top plan view showing dimensions of an optic according to embodiments.
Figure 5B:
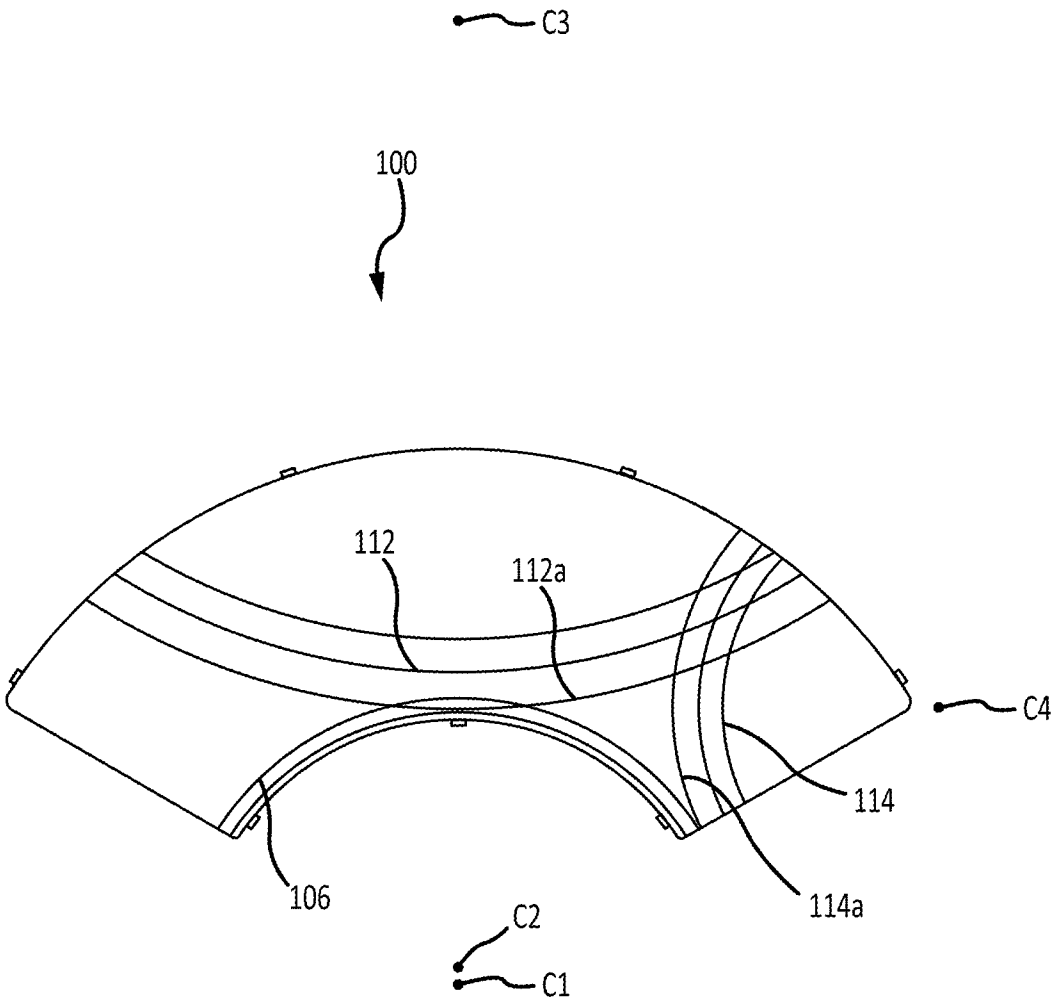
FIG. 5B illustrates a schematic top plan view showing dimensions of an optic according to embodiments.

The optic diameter may play a role to achieve the golden ratio in appearance, so outermost arc-shaped groove 114*a* may be between about 10% and 40% (oftentimes between about 15% and 30%) larger than an outer diameter of the optic 100. Table 1 below illustrates two examples of optic/radii sizes and ratios for the example optic dimensions shown in FIGS. 5A (smaller optic) and 5B (larger optic). It will be appreciated that the values in Table 1 are merely meant as non-limiting examples.

TABLE 1

| Small Size Luminaire | Measuremen | Ratio | Large Size Luminaire | Measurements | Ratio |
|---|---|---|---|---|---|
| 112A: Outer Radius | 190.5: 148.6 | 1.3:1 | 112A: Outer Radius | 203.02: 176.1 | 1.15:1 |
| 112A: 114A | 190.5: 74.11 | 2.6:1 | 112A: 114A | 203.02: 101.5 | 2.0:1 |
| 112A: 112 | 190.5: 180.2 | 1.05:1 | 112A: 112 | 203.02: 192.72 | 1.05:1 |
| 112: 112 | 180.2: 170.6 | 1.05:1 | 112: 112 | 192:72: 183.0 | 1.05:1 |
| | | | 114A: 114 | 101.5: 94.2 | 1.07:1 |

For example, the radius of each annular groove 106 may be measured from central axis C1. The radius of each arc-shaped groove 112 and arc-shaped groove 112A may be measured from central axis C2. The radius of each arc-shaped groove 114 and arc-shaped groove 114A may be measured from central axis C3.

The optic 100, when mechanical in nature, may be formed of any suitable material, including glass, polymers (e.g., acrylics, silicones, polycarbonates, etc.) other optical materials, and/or combinations thereof. In other embodiments, the optic 100 may be formed from an optical microfilm. When optic 100 takes the form of a microfilm, rings of microstructures may be formed that provide a similar visual effect. For example, the rings of microstructures may be laid out in a similar pattern of arcs and radii, with the microstructures operating to shape light in a similar way as the ridges and grooves described above.

Figure 2A:
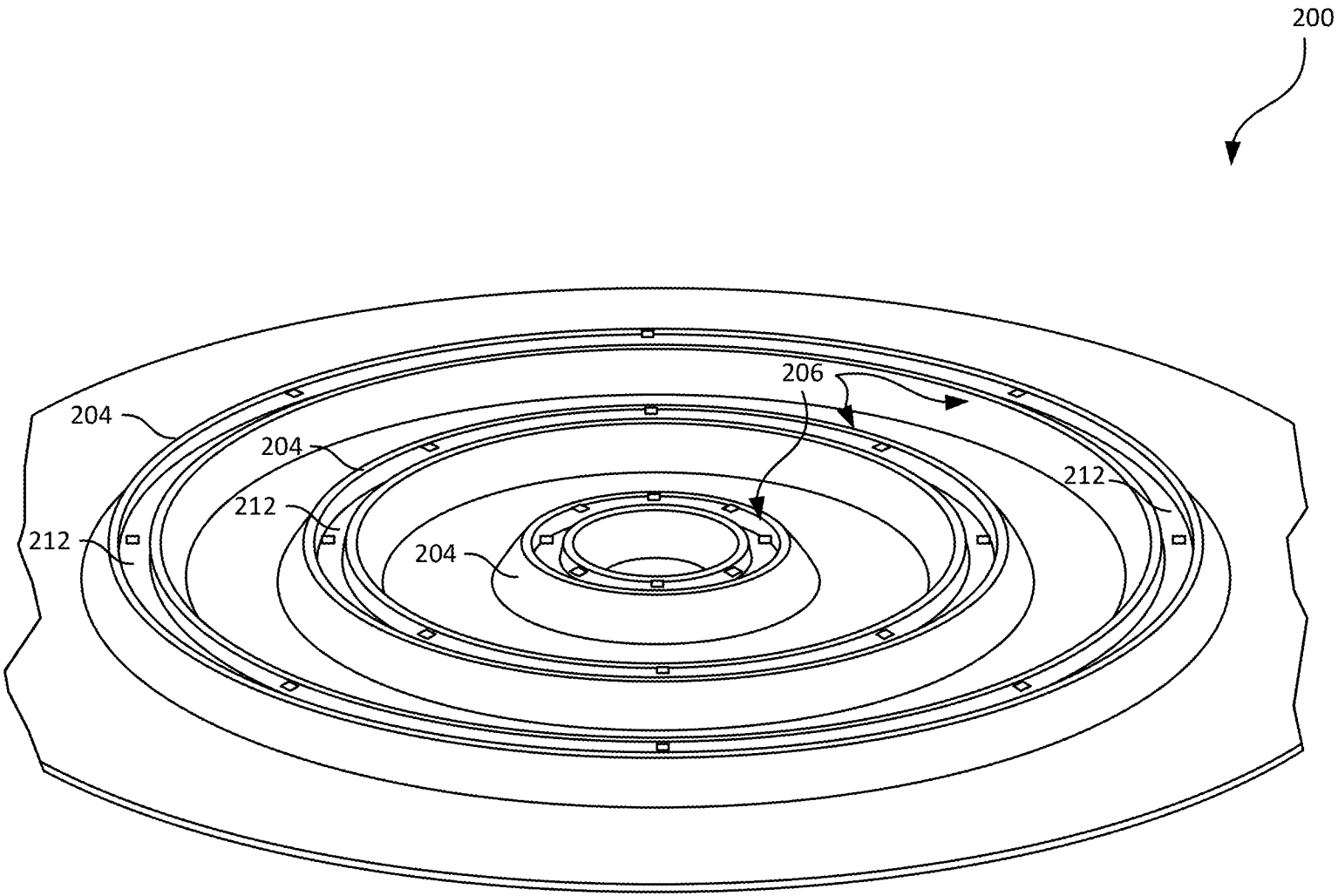
FIG. 2A illustrates a top isometric view of a TIR optic according to embodiments.
Figure 2B:
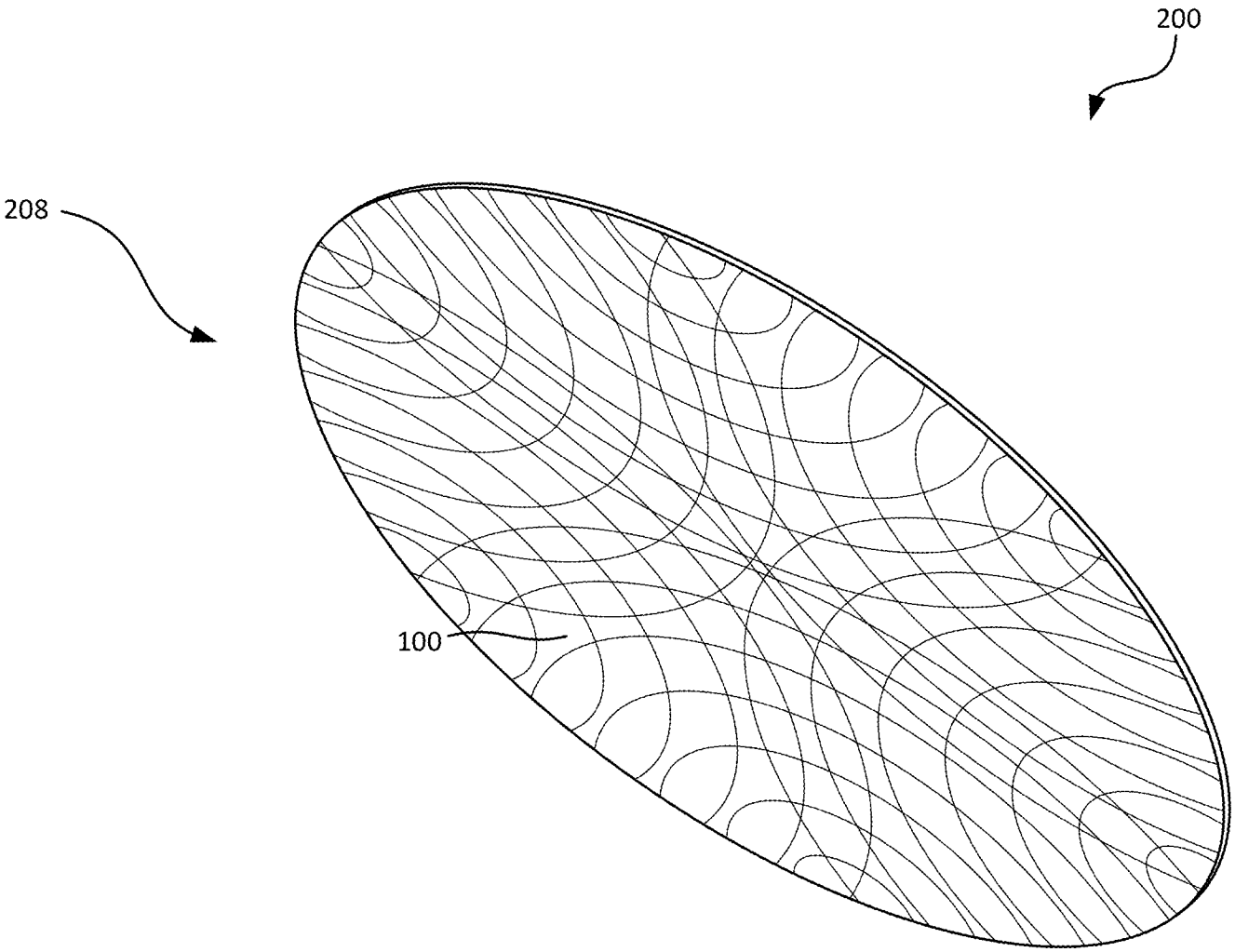
FIG. 2B illustrates a bottom isometric view of the TIR optic of FIG. 2A.
Figure 2C:
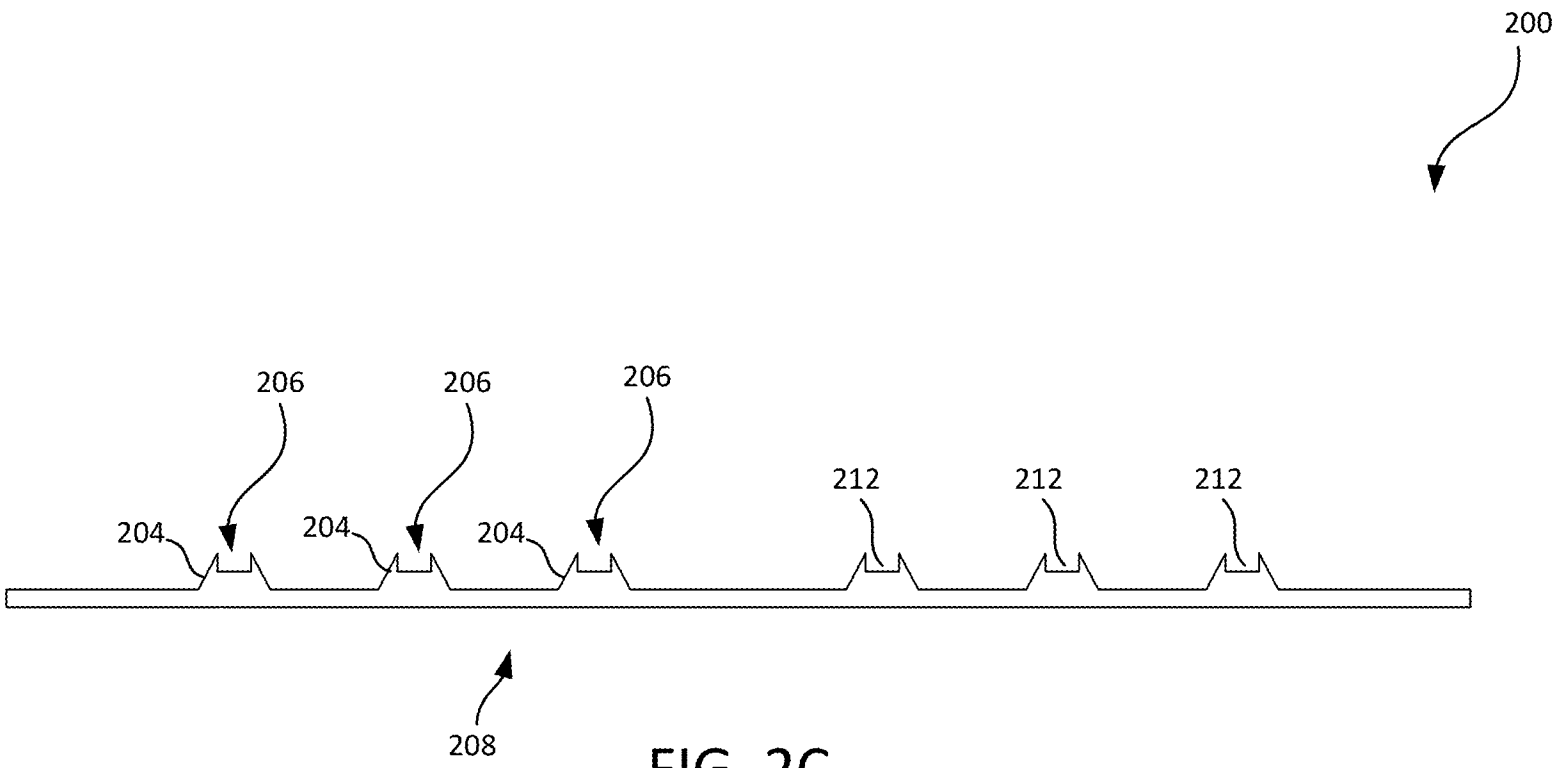
FIG. 2C illustrates a front elevation cross-sectional view of the TIR optic of FIG. 2A.
Figure 2D:
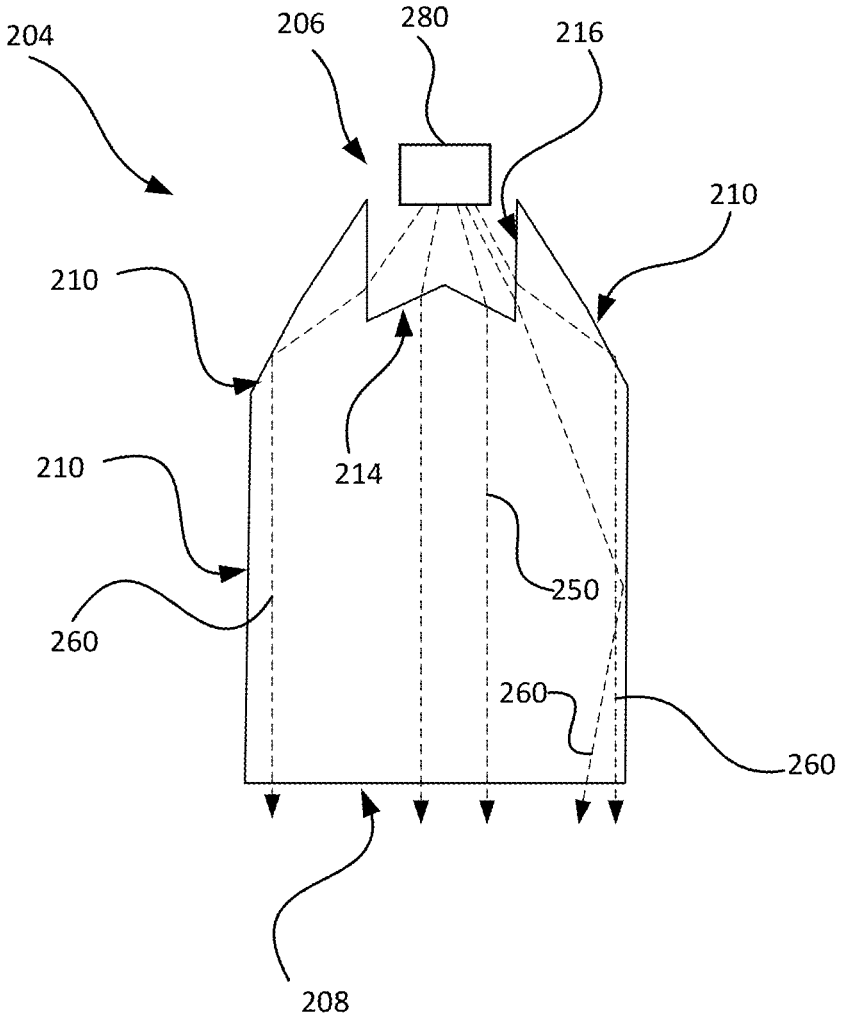
FIG. 2D illustrates a partial cross-sectional view of a TIR lens section of the TIR optic of FIG. 2A.

In some embodiments, the optic 100 may be incorporated into a total internal reflection (TIR) optic 200. For example, as illustrated in FIGS. 2A-2D, the optic 100 may be formed into and/or coupled with a light exit side 202 of TIR optic 200. This enables the TIR optic 200 to serve as a primary stage optic to generate light with a desired set of optical angles and distributions, while the optic 100 increases the pixilation of the LEDs to produce light which fully saturates the eye and makes luminaires look more uniformly illuminated. The TIR optic 200 may include a number of annular-shaped TIR lens sections 204. While shown here with three TIR lens sections 204, it will be appreciated that any number of TIR lens sections 204 may be included. Oftentimes, the number of TIR lens sections 204 will match a number of annularly arranged rows of LEDs and/or other light elements present on a light engine. Each TIR lens section 204 may include a cross-section that reflects high angle light and refracts low angle light, and may be coupled into a light guide and/or other component of a luminaire. Each TIR lens section 204 may be formed as an approximately parabolic cross-sectional profile that has been rotated to form the toroidal-shaped TIR lens section 204 that is symmetrical about a central axis of the TIR optic 200. A light entrance side of each TIR lens section 204 may define an annular channel 212, which may receive and/or otherwise be aligned with a number of LEDs and/or other lighting elements that are arranged in an annular shape about a light engine. A cross-sectional view of a TIR lens section 204 and one of a number of LEDs 280 is shown in FIG. 2D. As illustrated, the TIR lens section 204 may include a light entrance side 206 and a light exit side 208. A reflective prism (second section of a collimator) 210 may extend between the light entrance side 206 and the light exit side 208. As noted above, the light entrance side 206 may form a channel 212 that extends annularly around the TIR lens section 204. The channel 212 may include a refractive prism (first section of the collimator) 214 and side walls that form side incidence surfaces 216. LEDs 280 and/or other lighting elements of a light engine may be positioned aligned with and/or at least partially inserted within the channel 212 such that light emitted from the LEDs 280 is directed to the refractive prism 214 and side incidence surfaces 216 of the TIR lens section 204. For example, the refractive prism 214 may have a dome-like shape (with straight and/or curved surfaces) and may receive first rays 250 of the light emanating from the LEDs 280 that is aligned with and/or substantially aligned with an optical axis of the TIR lens section 204 and refracts and focuses rays emitted from around an optical axis of each LED 280 into rays 260 that are parallel with or substantially parallel with a collimation axis of the TIR lens section 204. Each side incidence surface 216 is configured to receive second rays 270 of light that are emitted from the LEDs 280 off-axis relative to the optical axis of the TIR optic 200. The side incidence surfaces 216 are configured to direct light to the reflective prism 214, which then utilizes principles of total internal reflection to re-orient the light into a direction that is parallel with or substantially parallel with a collimation axis of the TIR optic 200. For example, a light beam emitted from the light exit side 208 may have a beam angle of between about 15 and 60 degrees, depending on the TIR profile shape (204 and 206).

In the present embodiment, total internal reflection occurs when a ray of light strikes the reflective prism 214 at an angle larger than some critical angle with respect to the normal of the reflective prism 214, where the critical angle is equal to the arcsin of the refractive index of air/the refractive index of the reflective prism 214. If the refractive index is lower on the other side of the boundary, no light can pass through, so effectively all of the light is reflected. To achieve this reflection, the reflective prism 214 may have a smooth surface that provides a uniform interface between the TIR optic 200 and the air. When the angle of incidence of rays hitting the reflective prism 214 exceed the critical angle, the light is reflected into the lens material and generally along the collimator direction of the TIR optic 200.

As noted above, the light exit side 208 of the TIR optic 200 may include optic 100. For example, optic 100 may be formed on the light exit side 208 of the TIR optic 200, such as by injection molding and/or cutting (such as by using a computer numerical control (CNC) machine) the features into the light exit side 208. In such embodiments, the optic 100 (and TIR optic 200) may be formed from a single piece of material. In other embodiments, the optic 100 may be one or more separate components (such as segments 102) that are coupled with the light exit side 208 of the TIR optic 200 using one or more fasteners, snaps, and/or other mating features. For example, the optic 100 and/or segments thereof may be arranged about a face of the light exit side 208 of the TIR optic 200, with at least some of the annular grooves 106 in alignment with the channels 212 of the TIR lens sections 204 of the TIR optic 200. In some embodiments, all regions of the light exit side 208 of the TIR optic 200 may be textured by grooves and/or ridges. In other embodiments, some regions of the light exit side 208 of the TIR optic 200 may be devoid of texture. For example, regions that are radially inward of an innermost TIR lens section 204 and/or radially outward of an outermost TIR lens section 204 may be devoid of any grooves and/or ridges.

Figure 3:
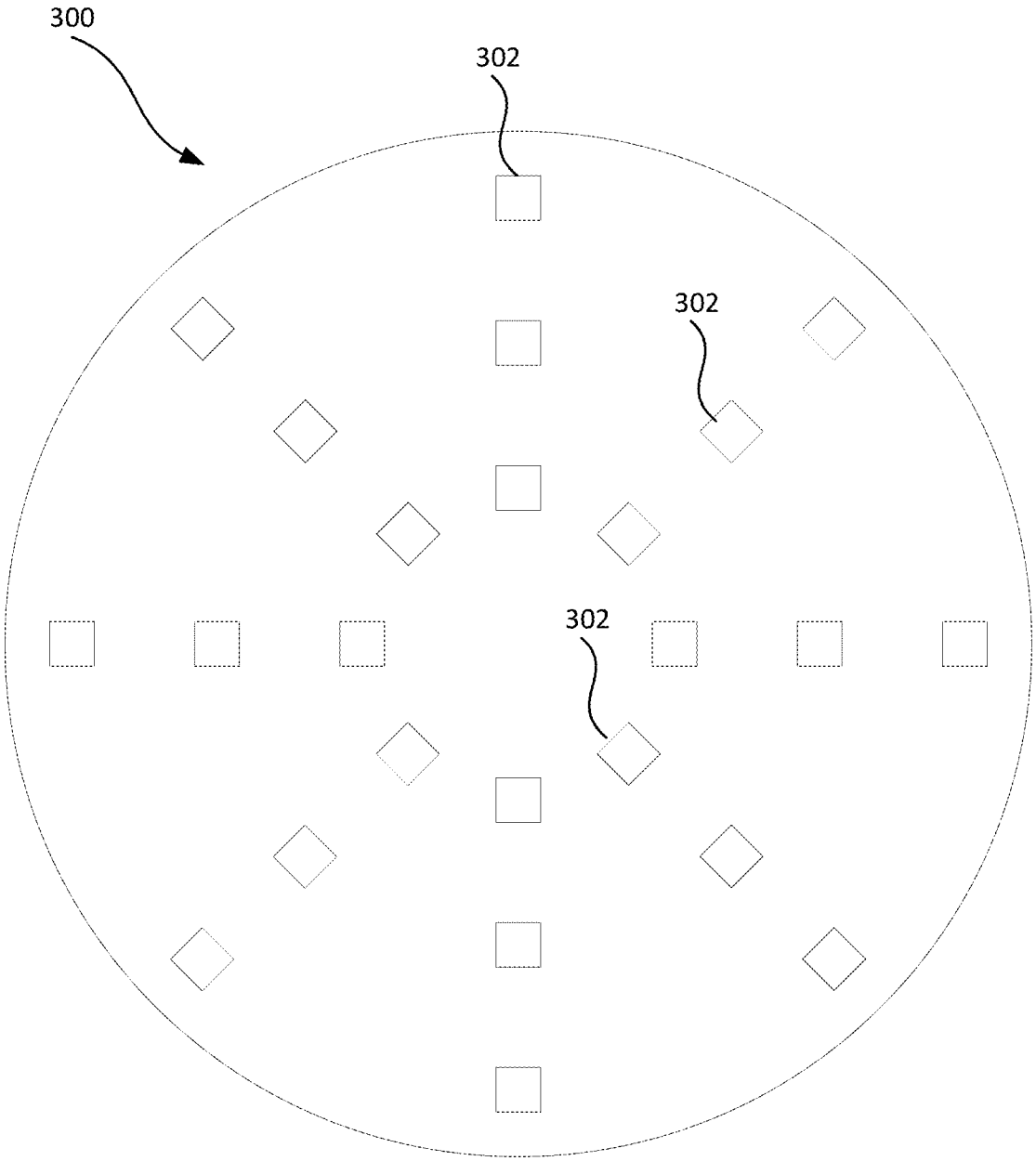
FIG. 3 illustrates a schematic top plan view of a light engine according to embodiments.

FIG. 3 illustrates one embodiment of a light engine 300. As illustrated, light engine 300 is generally circular in shape, although the light engine 300 may be any other shape, such as annular, rectangular, etc. The light engine 300 may include a number of LEDs 302 disposed about a surface of the light engine 300. For example, the LEDs 302 may be arranged as one or more annular rings, with multiple LEDs 302 in each ring. For example, a number of rings of LEDs 302 may match a number of TIR lens sections 204 of TIR optic 200. Each ring of LEDs 302 may be sized and shaped to be aligned with the channels 212 of the TIR optic 200, such that light from each LED 302 may enter a respective channel 212 and pass through the light entrance side 206 of the TIR optic 200. In some embodiments, each of LEDs 302 may also be aligned with a respective one of the annular grooves 106 of the optic 100 such that the Fresnel lines of the annular grooves 106 may control distribution of light from the LEDs 302 to narrowly focus the light. In other embodiments, optical axes of some or all of the LEDs 302 may be offset relative to the annular grooves 106.

While illustrated with a three rows of LEDs 302 positioned at regular intervals, it will be appreciated that other numbers of rings and/or arrangements of LEDs 302 are possible. For example, LEDs 302 may be spaced at irregular angular intervals within one or more of the rings. Additionally, while shown with the LEDs 302 of each ring at similar angular positions about a circumference of the light engine 300, it will be appreciated that the LEDs 302 in one or more rows may be staggered and/or otherwise angularly offset from one another relative to a central axis of the optic 100. However, by using a symmetrical and regular arrangement of LEDs 302, light emitted from the light engine 300 may be more uniform and more visually appealing. The use of a high number of LEDs 302 may enable the light engine 300 to provide a high lumen output. The light engine 300 may also include an LED driver and/or other optical, thermal, mechanical and/or electrical components (not shown) that are necessary to operate the LEDs 302.

Figure 4:
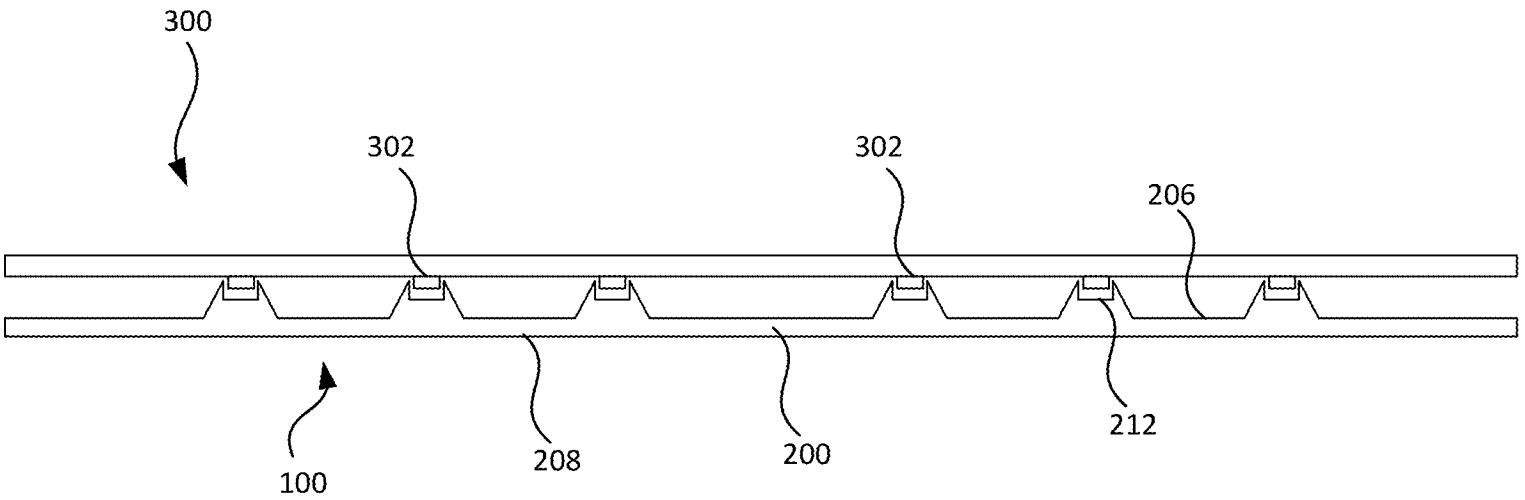
FIG. 4 illustrates a front elevation cross-sectional view of an assembly of a light engine, TIR optic, and optic according to embodiments.

FIG. 4 illustrates a side view of an assembly of the light engine 300, TIR optic 200, and optic 100. The light engine 300 may be positioned on the light entrance side 206 of the TIR optic 200 such that each LED 302 of the light engine 300 is aligned with a respective channel 212 of the TIR optic 200. In some embodiments, each LED 302 may extend at least partially into a respective channel 212, while in other embodiments each LED 302 may be aligned with, but remain fully out of the channel 212. Optic 100 may be formed into and/or coupled with the light exit side 208 of the TIR optic 200 such that the TIR optic 200 serves as a primary stage optic and the optic 100 serves as a secondary stage optic.

In some embodiments, the assembly may also include a housing to provide a luminaire. The housing may be of any shape or size to receive the assembly and to provide a luminaire having a desired profile. For example, while shown as having the light engine 300, TIR optic 200, and optic 100 be circular and/or annular in shape, it will be appreciated that some or all of these components may have other shapes, such as elliptical shapes, rectangular shapes, triangular shapes, and/or any other shape to suit the needs of a particular application. The housing may be sized and shaped accordingly to provide a desired luminaire design. FIG. 6 illustrates segments 102 of optic 100 mounted to a base 600 or other housing.

The optics described herein may be used independent of, or in conjunction with one or more optics. Other optics may include TIR optics such as TIR optic 200, and/or other optic elements. Additionally, it will be appreciated that some or all of the grooves may be implemented as ridges in some embodiments. Some embodiments may utilize a combination of ridges and grooves. Additional variations are contemplated.

Figure 7:
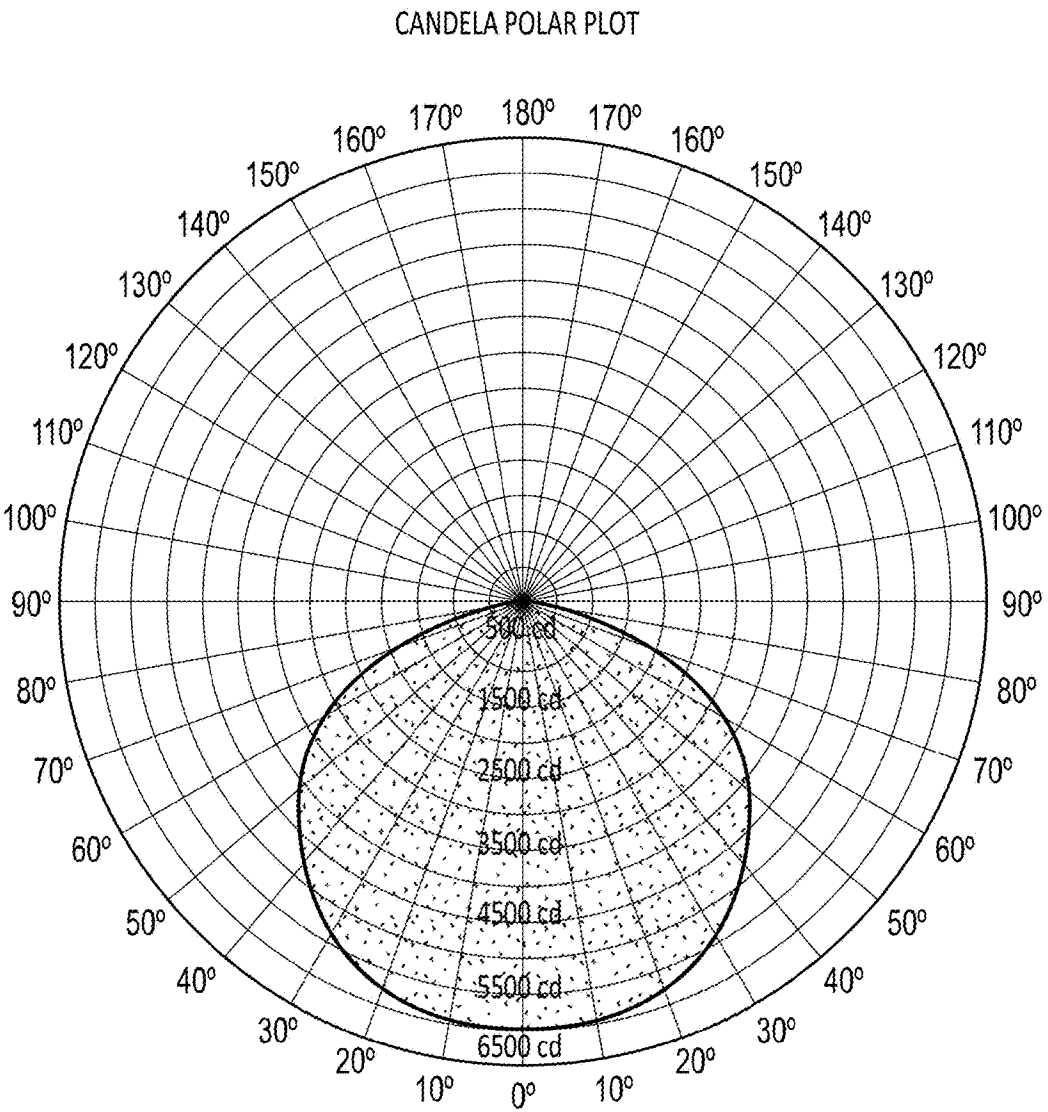
FIG. 7 illustrates a polar plot of a light distribution generated by a standard clear optic.
Figure 8:
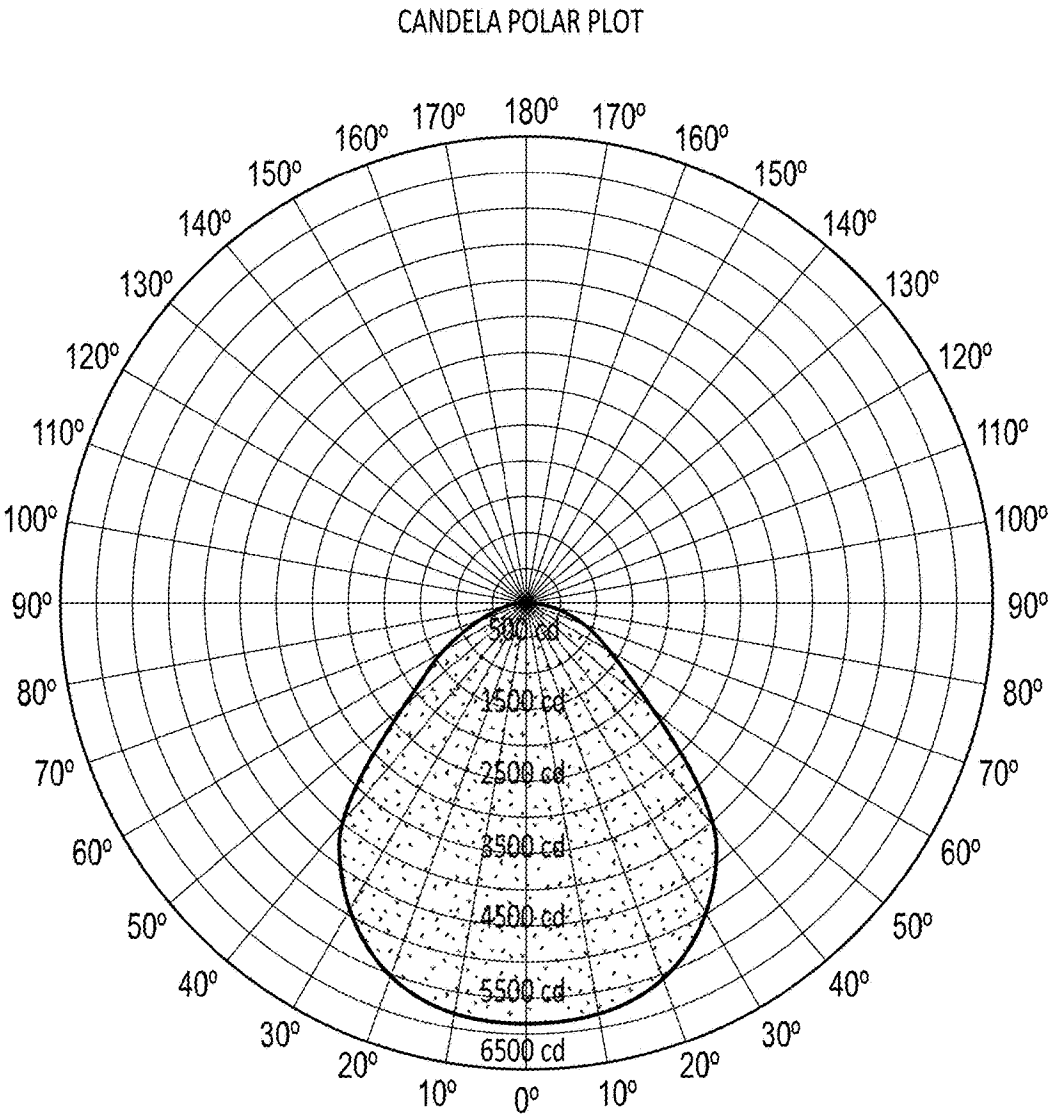
FIG. 8 illustrates a polar plot of a light distribution generated by a prototype optic according to embodiments of the present technology.

Prototype optics were fabricated based on the design considerations described above. The prototype optics change the distribution from "Lambertian" by pulling down high angle light and redirecting it to lower angles, towards nadir. This creates a low Unified Glare Rating distribution (LUGR), which takes on a teardrop shape as illustrated in FIGS. 7 (clear optic) and 8 (prototype optic). For high bay luminaires the luminaire may not exceed a UGR rating of 28. The UGR calculation is based most heavily fixture size, lumen output, and distribution. These three factors affect UGR as follows. A higher lumen output results in a higher UGR value, whereas a lower output results in a lower number. A larger fixture size reduces the UGR value but a smaller fixture size increases the UGR. A distribution with less high angle light reduces UGR but a distribution with heavy presence of high-angle light will increase the UGR value. Anything equal to or greater than 28 fails UGR, thus, does not meet the necessary glare standards. Tables 1 and 2 below illustrate UGR values for a recessed bay fixture that uses a clear lens vs an optic designed in accordance with the present technology. Lumen output for both optics was approximately 18600LM, with a same CCT/CRI and same fixture size for each optic. In a particular embodiment, to meet glare standards the UGR value may be based on the crosswise and endwise values for a 4H by 8H mounting ratio for a 70/50/20% reflectance.

TABLE 1

| UGR Clear Optic | | | | | | | | | | | |
|---|---|---|---|---|---|---|---|---|---|---|---|
| Ceiling reflectance | | 0.7 | 0.7 | 0.5 | 0.5 | 0.3 | 0.7 | 0.7 | 0.5 | 0.5 | 0.3 |
| Wall reflectance | | 0.5 | 0.3 | 0.5 | 0.3 | 0.3 | 0.5 | 0.3 | 0.5 | 0.3 | 0.3 |
| Plane reflectance | | 0.2 | 0.2 | 0.2 | 0.2 | 0.2 | 0.2 | 0.2 | 0.2 | 0.2 | 0.2 |
| Room dimensions | | Viewed crosswise | | | | | Viewed endwise | | | | |
| 2H | 2H | 26.5 | 28.2 | 26.9 | 28.5 | 28.8 | 26.5 | 28.1 | 26.8 | 28.5 | 28.8 |
| | 3H | 28.3 | 29.8 | 28.7 | 30.1 | 30.5 | 28.3 | 29.8 | 28.6 | 30.1 | 30.5 |
| | 4H | 28.9 | 30.3 | 29.3 | 30.7 | 31.1 | 28.9 | 30.3 | 29.3 | 30.6 | 31.0 |
| | 6H | 29.3 | 30.6 | 29.7 | 30.9 | 31.3 | 29.2 | 30.5 | 29.6 | 30.9 | 31.3 |
| | 8H | 29.3 | 30.6 | 29.8 | 31.0 | 31.4 | 29.3 | 30.5 | 29.7 | 30.9 | 31.3 |
| | 12H | 29.3 | 30.5 | 29.8 | 30.9 | 31.4 | 29.3 | 30.5 | 29.7 | 30.9 | 31.3 |
| 4H | 2H | 27.2 | 28.6 | 27.6 | 28.9 | 29.3 | 27.1 | 28.5 | 27.5 | 28.9 | 29.3 |
| | 3H | 29.2 | 30.4 | 29.6 | 30.8 | 3132 | 29.1 | 30.3 | 29.5 | 30.7 | 31.1 |
| | 4H | 29.9 | 31.0 | 30.3 | 31.4 | 31.8 | 29.8 | 30.9 | 30.3 | 31.3 | 31.7 |
| | 6H | 30.3 | 31.2 | 30.8 | 31.7 | 32.1 | 30.3 | 31.2 | 30.7 | 31.6 | 32.1 |
| | 8H | 30.4 | 31.3 | 30.9 | 31.7 | 32.2 | 30.3 | 31.2 | 30.8 | 31.7 | 32.1 |
| | 12H | 30.4 | 31.2 | 30.9 | 31.7 | 32.2 | 30.4 | 31.2 | 30.9 | 31.6 | 32.1 |
| 8H | 4H | 30.2 | 31.0 | 30.6 | 31.5 | 31.9 | 30.1 | 31.0 | 30.5 | 31.4 | 31.9 |
| | 6H | 30.7 | 31.4 | 31.1 | 31.9 | 32.3 | 30.6 | 31.3 | 31.1 | 31.8 | 32.3 |
| | 8H | 30.8 | 31.4 | 31.3 | 31.9 | 32.4 | 30.7 | 31.4 | 31.2 | 31.9 | 32.4 |
| | 12H | 30.8 | 31.4 | 31.4 | 31.9 | 32.5 | 30.8 | 31.3 | 31.3 | 31.8 | 32.4 |
| 12H | 4H | 30.2 | 30.9 | 30.6 | 31.4 | 31.9 | 30.1 | .039 | 30.6 | 31.4 | 31.8 |
| | 6H | 30.7 | 31.3 | 31.2 | 31.8 | 32.3 | 30.6 | 31.3 | 31.1 | 31.7 | 32.3 |
| | 8H | 30.8 | 31.4 | 31.3 | 31.9 | 32.5 | 30.8 | 31.3 | 31.3 | 31.8 | 32.4 |

TABLE 2

| UGR Prototype Optic | | | | | | | | | | | |
|---|---|---|---|---|---|---|---|---|---|---|---|
| Ceiling reflectance | | 0.7 | 0.7 | 0.5 | 0.5 | 0.3 | 0.7 | 0.7 | 0.5 | 0.5 | 0.3 |
| Wall reflectance | | 0.5 | 0.3 | 0.5 | 0.3 | 0.3 | 0.5 | 0.3 | 0.5 | 0.3 | 0.3 |
| Plane reflectance | | 0.2 | 0.2 | 0.2 | 0.2 | 0.2 | 0.2 | 0.2 | 0.2 | 0.2 | 0.2 |
| Room dimensions | | Viewed crosswise | | | | | Viewed endwise | | | | |
| 2H | 2H | 23.5 | 25.0 | 23.8 | 25.3 | 25.6 | 23.5 | 25.0 | 23.8 | 25.3 | 25.6 |
| | 3H | 25.1 | 26.5 | 25.5 | 26.8 | 27.2 | 25.1 | 26.5 | 25.5 | 26.8 | 27.2 |
| | 4H | 25.8 | 27.1 | 26.2 | 27.4 | 27.8 | 25.8 | 27.1 | 26.2 | 27.4 | 27.8 |
| | 6H | 26.5 | 27.6 | 26.9 | 28.0 | 28.4 | 26.5 | 27.6 | 26.9 | 28.0 | 28.4 |
| | 8H | 26.7 | 27.8 | 27.1 | 28.2 | 28.6 | 26.7 | 27.8 | 27.1 | 28.2 | 28.6 |
| | 12H | 26.9 | 27.9 | 27.3 | 28.3 | 28.8 | 26.9 | 27.9 | 27.3 | 28.3 | 28.8 |
| 4H | 2H | 24.0 | 25.3 | 24.4 | 25.6 | 26.0 | 24.0 | 25.3 | 24.4 | 25.6 | 26.0 |
| | 3H | 25.9 | 27.0 | 26.3 | 27.4 | 27.8 | 25.9 | 27.0 | 26.3 | 27.4 | 27.8 |
| | 4H | 26.8 | 27.7 | 27.2 | 28.1 | 28.6 | 26.8 | 27.7 | 27.2 | 28.1 | 28.6 |
| | 6H | 27.6 | 28.4 | 28.0 | 28.8 | 29.3 | 27.6 | 28.4 | 28.0 | 28.8 | 29.3 |
| | 8H | 27.9 | 28.6 | 28.3 | 29.1 | 29.6 | 27.9 | 28.6 | 28.3 | 29.1 | 29.6 |
| | 12H | 28.1 | 28.8 | 28.6 | 29.3 | 29.8 | 28.1 | 28.8 | 28.6 | 29.3 | 29.8 |
| 8H | 4H | 27.1 | 27.9 | 27.6 | 28.3 | 28.8 | 27.1 | 27.9 | 27.6 | 28.3 | 28.8 |
| | 6H | 28.1 | 28.7 | 28.6 | 29.2 | 29.7 | 28.1 | 28.7 | 28.6 | 29.2 | 29.7 |
| | 8H | 28.5 | 29.0 | 29.0 | 29.6 | 30.0 | 28.5 | 29.0 | 29.0 | 29.6 | 30.0 |
| | 12H | 28.8 | 29.3 | 29.3 | 29.8 | 30.4 | 28.8 | 29.3 | 29.3 | 29.8 | 30.4 |
| 12H | 4H | 27.2 | 27.8 | 27.6 | 28.3 | 28.8 | 27.2 | 27.8 | 27.6 | 28.3 | 28.8 |
| | 6H | 28.2 | 28.7 | 28.7 | 29.2 | 29.7 | 28.2 | 28.7 | 28.7 | 29.2 | 29.7 |
| | 8H | 28.6 | 29.1 | 29.1 | 29.6 | 30.2 | 28.6 | 29.1 | 29.1 | 29.6 | 30.2 |

The prototype optics provided a somewhat tear-drop shaped light distribution as illustrated in FIGS. 7 (clear optic) and 8 (prototype optic). Due to the side of the distribution and excellent cut off angle, the prototype optic was able to provide a UGR of less than 28. The prototype optic produced the illustrated distribution on a high lumen fixture and obtained a UGR of 27.6/27.5 with 87.1% of lumens focused in a zone of 0°±60°, while a target lumen percentage is between 80% to 100% of the lumens focused within the zone of 0°±60°.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

While illustrative and presently preferred embodiments of the disclosed systems have been described in detail herein, it is to be understood that the inventive concepts may be otherwise variously embodied and employed, and that the appended claims are intended to be construed to include such variations, except as limited by the prior art.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or +0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or +0.1% from the specified value, as such variations are appropriate to in the context of the systems, devices, circuits, methods, and other implementations described herein. As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

What is claimed is:

1. A luminaire, comprising:

a light engine comprising a plurality of light sources arranged in one or more annular rows; and an optic, comprising:

an annular optic body having a light entrance side facing the plurality of light sources and a light exit side opposite the light entrance side;

a plurality of annular grooves that protrude into the light exit side, the plurality of annular grooves being coaxial with the optic body;

a plurality of arc-shaped grooves that protrude into the light exit side, each of the plurality of arc-shaped grooves being convex relative to a center of the optic, wherein:

each of the plurality of arc-shaped grooves intersects at least one of the plurality of annular grooves; and the optic is configured to produce a Unified Glare Rating of less than 28.

2. The luminaire of claim 1, wherein:

the plurality of arc-shaped grooves comprises a first plurality of arc-shaped grooves and a second plurality of arc-shaped grooves;

the first plurality of arc-shaped grooves are coaxial with one of a plurality of first central axes that are radially outward of an outer edge of the optic body;

the second plurality of arc-shaped grooves are coaxial with one of a plurality of second central axes that are each substantially aligned with the outer edge of the optic body; and each of the plurality of first central axes and each of the plurality of second central axes are angularly offset from one another.

3. The luminaire of claim 2, wherein:

each of the first plurality of arc-shaped grooves intersects at least one of the second plurality of arc-shaped grooves.

4. The luminaire of claim 2, wherein:

individual ones of the first plurality of arc-shaped grooves have greater radii of arc-shaped grooves than individual ones of the second plurality of arc-shaped grooves that are at similar radial positions of the optic.

5. The luminaire of claim 2, wherein:

the plurality of first central axes comprise three first central axes spaced apart about a circumference of the optic body; and the plurality of second central axes comprise three second central axes spaced apart about the circumference of the optic body.

6. The luminaire of claim 1, wherein:

each of the plurality of annular grooves and each of the plurality of arc-shaped grooves comprise a v-groove.

7. The luminaire of claim 1, wherein:

an angle of each of the plurality of annular grooves and an angle of each of the plurality of arc-shaped grooves is substantially the same relative to a reference plane that is orthogonal to a depth of each of the plurality of annular grooves.

8. The luminaire of claim 7, wherein:

the angle of each of the plurality of annular grooves and the angle of each of the plurality of arc-shaped grooves is between about 20 degrees and 45 degrees relative to the reference plane.

9. The luminaire of claim 1, wherein:

at least about 95% of the light exit side is non-planar.

10. An optic, comprising:

an annular optic body having a light entrance side and a light exit side;

a plurality of annular grooves defined within the light exit side, the plurality of annular grooves being coaxial with the optic body;

a plurality of arc-shaped grooves defined within the light exit side, each of the plurality of arc-shaped grooves being convex relative to a center of the optic, wherein:

each of the plurality of arc-shaped grooves intersects at least one of the plurality of annular grooves; and the optic is configured to produce a Unified Glare Rating of less than 28.

11. The optic of claim 10, wherein:

the plurality of arc-shaped grooves comprises a first plurality of arc-shaped grooves and a second plurality of arc-shaped grooves;

the first plurality of arc-shaped grooves are coaxial with one of a plurality of first central axes that are radially outward of an outer edge of the optic body; and the second plurality of arc-shaped grooves are coaxial with one of a plurality of second central axes that are each substantially aligned with the outer edge of the optic body.

12. The optic of claim 11, wherein:

the plurality of first central axes are disposed at 120° intervals about the optic body;

the plurality of second central axes are disposed at 120° intervals about the optic body; and the plurality of first central axes are offset from the plurality of second axes by 60°.

13. The optic of claim 11, wherein:

outermost arc-shaped grooves of the first plurality of arc-shaped grooves have greater depths than more inward arc-shaped grooves of the first plurality of arc-shaped grooves; and outermost arc-shaped grooves of the second plurality of arc-shaped grooves have greater depths than more inward arc-shaped grooves of the second plurality of arc-shaped grooves.

14. The optic of claim 11, wherein:

the optic body comprises a plurality of arcuate segments; and each of the plurality of segments defines a subset of the plurality of annular grooves, the first plurality of arc-shaped grooves, and the second plurality of arc-shaped grooves.

15. The optic of claim 14, wherein:

each of the plurality of second central axes is azimuthally aligned with an intersection between two of the plurality of segments.

16. The optic of claim 11, wherein:

one or more of the first plurality of arc-shaped grooves intersect one or more of the second plurality of arc-shaped grooves.

17. An optic, comprising:

an arcuate optic body having a light entrance side and a light exit side;

a plurality of annular grooves defined within the light exit side, the plurality of annular grooves being coaxial with the optic body;

a first plurality of arc-shaped grooves defined within the light exit side, wherein each of the first plurality of arc-shaped grooves is coaxial with a first central axis that is radially outward of an outer edge of the optic body; and a second plurality of arc-shaped grooves defined within the light exit side, wherein each of the second plurality of arc-shaped grooves is coaxial with one of a plurality of second central axes that are each substantially aligned with the outer edge of the optic body, wherein:

each of the plurality of first arc-shaped grooves and each of the plurality of second arc-shaped grooves intersects at least one of the plurality of annular grooves; and the optic is configured to produce a Unified Glare Rating of less than 28.

18. The optic of claim 17, wherein:

a depth of at least one of the first plurality of arc-shaped grooves is different from a depth of at least one other of the first plurality of arc-shaped grooves; and a depth of at least one of the second plurality of arc-shaped grooves is different from a depth of at least one other of the second plurality of arc-shaped grooves.

19. The optic of claim 17, wherein:

the light entrance side of the optic body is substantially planar.

20. The optic of claim 17, wherein:

each of the second central axes is substantially aligned with an outer corner of the optic body.

* * * * *